US008414038B2

(12) United States Patent
Bedekar et al.

(10) Patent No.: US 8,414,038 B2
(45) Date of Patent: Apr. 9, 2013

(54) VEHICLE DOOR LATCH STRUCTURE

(75) Inventors: Kaustubh Bedekar, Farmington Hills, MI (US); Jeffrey Tobey, Sterling Heights, MI (US); Gunnar Mason, Holly, MI (US)

(73) Assignee: Nissan North America, Inc., Franklin, TN (US)

( * ) Notice: Subject to any disclaimer, the term of this patent is extended or adjusted under 35 U.S.C. 154(b) by 331 days.

(21) Appl. No.: 12/855,125

(22) Filed: Aug. 12, 2010

(65) Prior Publication Data

US 2012/0036785 A1 Feb. 16, 2012

(51) Int. Cl.
*E05C 3/06* (2006.01)
*E05C 3/16* (2006.01)

(52) U.S. Cl. ..... 292/216; 292/DIG. 22; 292/DIG. 65; 296/146.6; 296/187.12

(58) Field of Classification Search ..... 292/201, 292/216, DIG. 22, DIG. 23, DIG. 65; 296/146.6, 296/187.12
See application file for complete search history.

(56) References Cited

U.S. PATENT DOCUMENTS 3,799,596 A * 3/1974 Nozomu et al. ..... 292/216
4,536,021 A * 8/1985 Mochida ..... 292/201
5,492,379 A * 2/1996 Staser et al. ..... 292/336.3
5,752,346 A * 5/1998 Kritzler et al. ..... 49/503
5,865,481 A * 2/1999 Buschmann ..... 292/216
6,065,797 A * 5/2000 Shirasaka ..... 296/146.6
7,481,468 B2 1/2009 Merideth et al.
7,607,702 B2 * 10/2009 Pereverzev ..... 292/216
7,648,192 B2 1/2010 Herline et al.
8,079,631 B2 * 12/2011 Higgins et al. ..... 296/146.1
8,128,151 B2 * 3/2012 Teramoto et al. ..... 296/146.1
8,162,360 B2 * 4/2012 Takaya et al. ..... 292/336.3
8,235,451 B2 * 8/2012 Jordan et al. ..... 296/146.1
2007/0013206 A1 * 1/2007 Huttsell et al. ..... 296/146.6
2007/0069525 A1 * 3/2007 Ghannam ..... 292/216
2008/0276538 A1 * 11/2008 Costigan ..... 49/375
2010/0019512 A1 * 1/2010 Gschweng et al. ..... 292/217
2010/0109350 A1 * 5/2010 Gschweng et al. ..... 292/196
2011/0233944 A1 * 9/2011 Konchan ..... 292/216

OTHER PUBLICATIONS

Nissan Technical Center North America, Inc., Nissan Lock Bracket Concept, Jul. 2003.

* cited by examiner

*Primary Examiner* — Carlos Lugo
(74) *Attorney, Agent, or Firm* — Global IP Counselors, LLP

(57) ABSTRACT

A vehicle door latch structure is basically provided with a door latch mechanism and a door latch engagement bracket. The door latch mechanism includes a latch release lever that is movably arranged between a rest position and a release position. The door latch engagement bracket defines an opening that is aligned with the latch release lever while the latch release lever is in the rest position such that the latch release lever extends through the opening upon movement of the door latch engagement bracket toward the latch mechanism while the latch release lever is in the rest position, and such that the door latch engagement bracket prevents movement of the latch release lever from the rest position to the release position while the latch release lever is extending through the opening in the door latch engagement bracket.

22 Claims, 18 Drawing Sheets

VEHICLE DOOR LATCH STRUCTURE

BACKGROUND

1. Field of the Invention

The present invention generally relates to a vehicle door. More specifically, the present invention relates to a vehicle door latch structure that includes an inadvertent unlatching prevention feature for preventing a latch release lever from moving from the rest position to the release position in response to an impact event that deforms an outer panel of a vehicle door.

2. Background Information

Vehicles normally have an outside door handle and an inside door handle that are operatively coupled to a latch mechanism to latch or unlatch a door to a vehicle body. These door handles have many different configurations. The outside door handle is sometimes provided with a counterweight to ensure that the outside door handle is not moved by an inertial movement of the outside door handle. During a side door impact event, the acceleration and/or the deformation of the door can also cause the door latch to become inadvertently unlatched. One method of preventing this type of inadvertently unlatching of a vehicle door latch mechanism is disclosed in U.S. Pat. No. 7,481,468. The latch mechanism of U.S. Pat. No. 7,481,468 includes an internal movable component that prevents movement of a latch plunger during an impact event, and then the internal movable component resets to allow movement of the latch plunger after conclusion of the impact event. Another method of preventing this type of inadvertently unlatching of a vehicle door latch mechanism was to provide a door bracket to which the door reinforcement bar attaches proximate to the latch, which will align cross-car with the latch. The door bracket crushes on impact to contact and surround the latch release lever of an exposed-type latch to prevent the latch release lever from moving enough to cause an unlatched condition. One example of such a door lever immobilizer bracket is disclosed in U.S. Pat. No. 7,648,192. In U.S. Pat. No. 7,648,192, the door lever immobilizer bracket deforms upon contact, and is pushed into the latch release lever so as to surround the lever or cause the lever to become deformed and non-functional. Another example of this type of door lever immobilizer bracket has been implemented in various Nissan vehicles since 2003. In these Nissan vehicles, the door lever immobilizer bracket was made of foam, and was positioned to surround the latch release lever to immobilize the lever in response to an impact event.

SUMMARY

In view of the state of the known technology, one aspect of the present disclosure is to provide a vehicle door latch structure that basically comprises a door latch mechanism and a door latch engagement bracket. The door latch mechanism includes a latch release lever that is movably arranged between a rest position and a release position. The door latch engagement bracket defines an opening that is aligned with the latch release lever while the latch release lever is in the rest position such that the latch release lever extends through the opening upon movement of the door latch engagement bracket toward the latch mechanism while the latch release lever is in the rest position, and such that the door latch engagement bracket prevents movement of the latch release lever from the rest position to the release position while the latch release lever is extending through the opening in the door latch engagement bracket.

Other features, aspects and advantages of the vehicle door latch structure of the present disclosure will become apparent to those skilled in the art from the following detailed description, which, taken in conjunction with the annexed drawings, discloses selected embodiments of the vehicle door latch structure.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
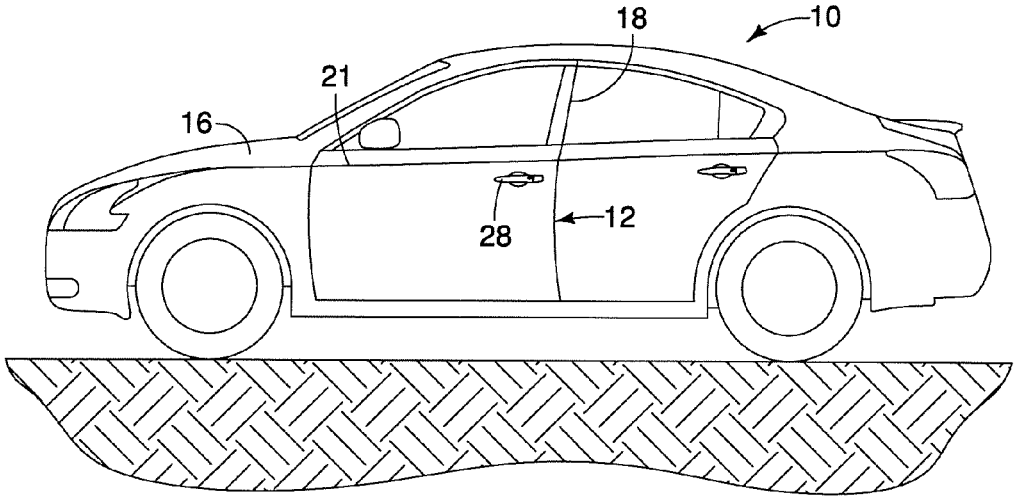
FIG. 1 is a side elevational view of a vehicle with a vehicle door latch structure in accordance with one embodiment.
Figure 2:
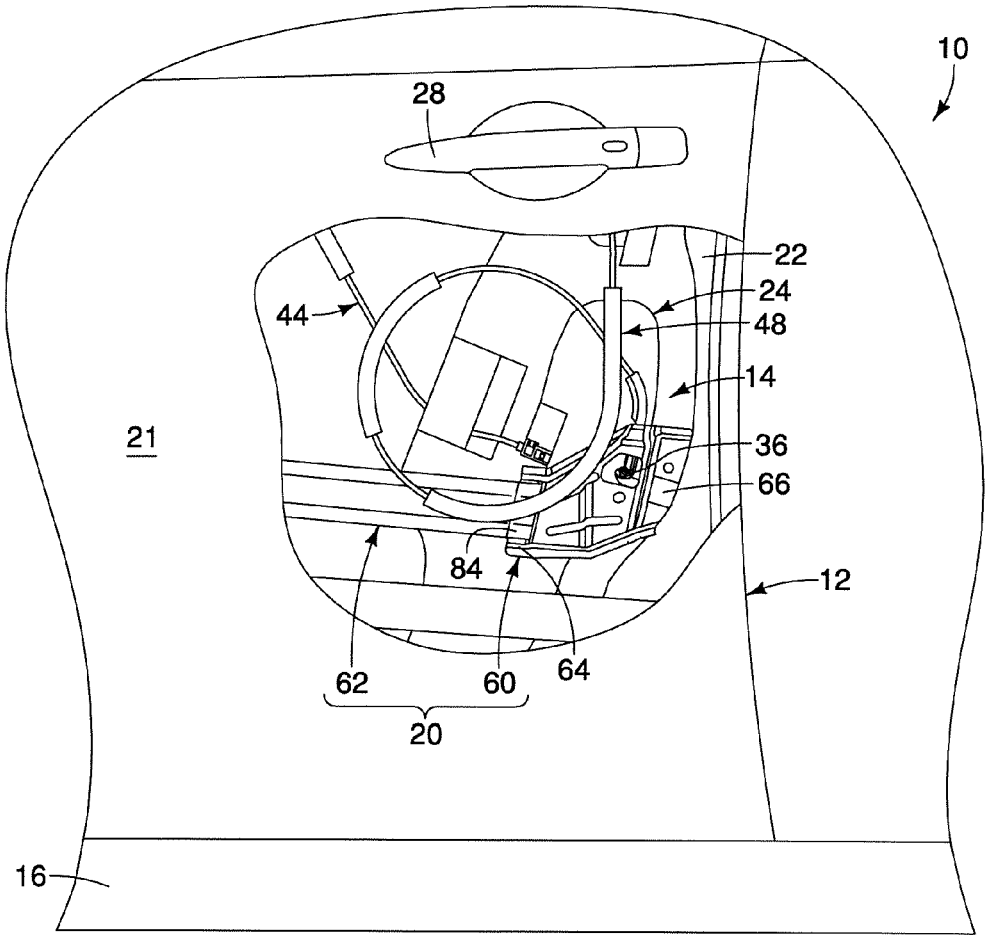
FIG. 2 is an enlarged side elevational view of a portion of the vehicle door with a portion of the outer door panel removed to reveal a portion of the vehicle door latch structure near the door latch engagement bracket.

Referring initially to FIGS. 1 and 2, a vehicle 10 is illustrated that has a vehicle door 12 with a vehicle door latch structure 14 in accordance with a first embodiment. The vehicle door 12 is pivotally supported on a vehicle body 16 of the vehicle 10 between a closed (latched) position and an open (unlatched) position in a conventional manner. Specifically, the vehicle door 12 is pivotally attached at its forward end to the vehicle body 16 by a pair of hinges (not shown). The rearward end of the vehicle door 12 includes parts of the vehicle door latch structure 14 for latching the vehicle door 12 to a B-pillar 18 of the vehicle body 16 in a releasable manner. As explained below, the vehicle door latch structure 14 is provided with an inadvertent unlatching prevention feature 20 for preventing the vehicle door 12 from inadvertently moving from the closed (latched) position to the open (unlatched) position in response to an impact event that deforms the vehicle door 12. Basically, as explained below, the unlatching prevention feature 20 is designed to crush in a controlled manner upon a side impact event against the vehicle door 12 to prevent the vehicle door 12 from inadvertently unlatching from the B-pillar 18 of the vehicle body 16. The door latch engagement bracket 60 and the door reinforcement member 62 cooperate together to form an inadvertent unlatching prevention feature 20 for preventing the vehicle door 12 from inadvertently moving from the closed (latched) position to the open (unlatched) position in response to an impact event that deforms the vehicle door 12.

Since the focus of the present disclosure is directed to the vehicle door latch structure 14, the vehicle 10 and the vehicle door 12 will not be discussed or illustrated herein, except as they relate to the vehicle door latch structure 14. Moreover, the vehicle door latch structure 14 can be applied to the remaining doors of the vehicle 10 as needed and/or desired.

Figure 3:
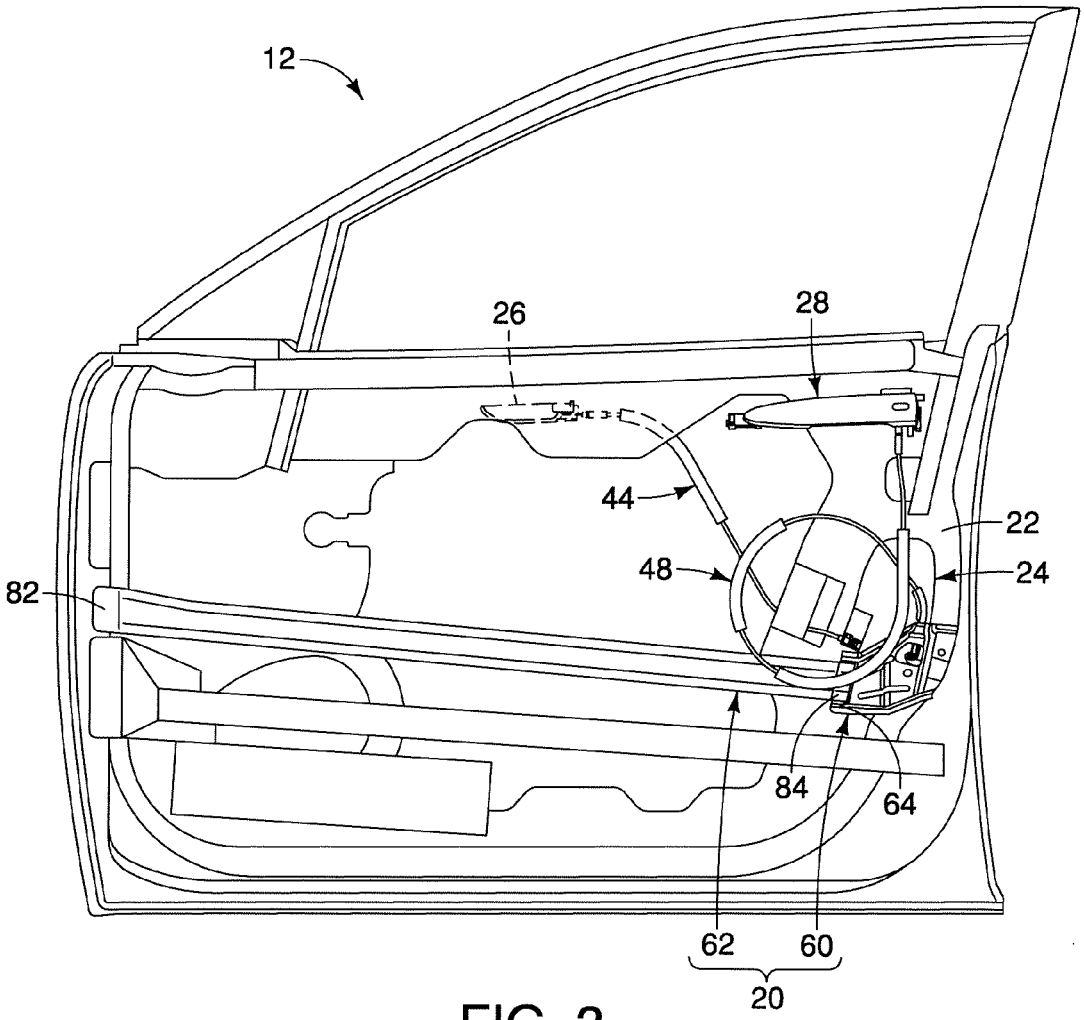
FIG. 3 is an elevational view of the vehicle door with the outer door panel removed to reveal the vehicle door latch structure.
Figure 4:
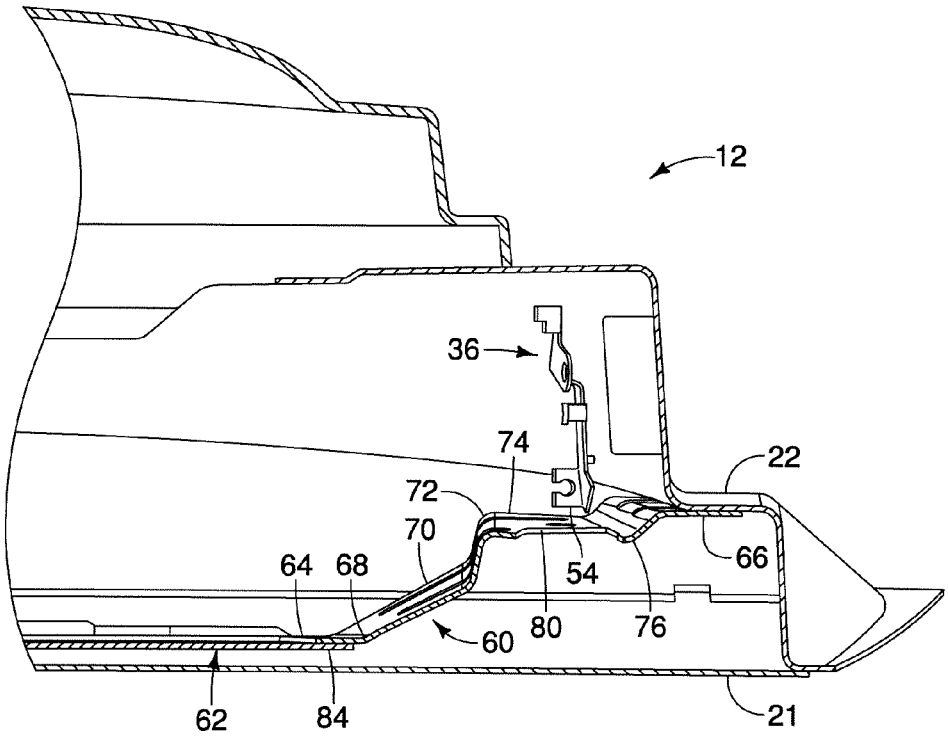
FIG. 4 is a simplified horizontal cross-sectional view of a rear portion of the vehicle door with selected parts removed to more clearly illustrate the door latch mechanism and the door latch engagement bracket with the main latch release lever in the rest position.
Figure 5:
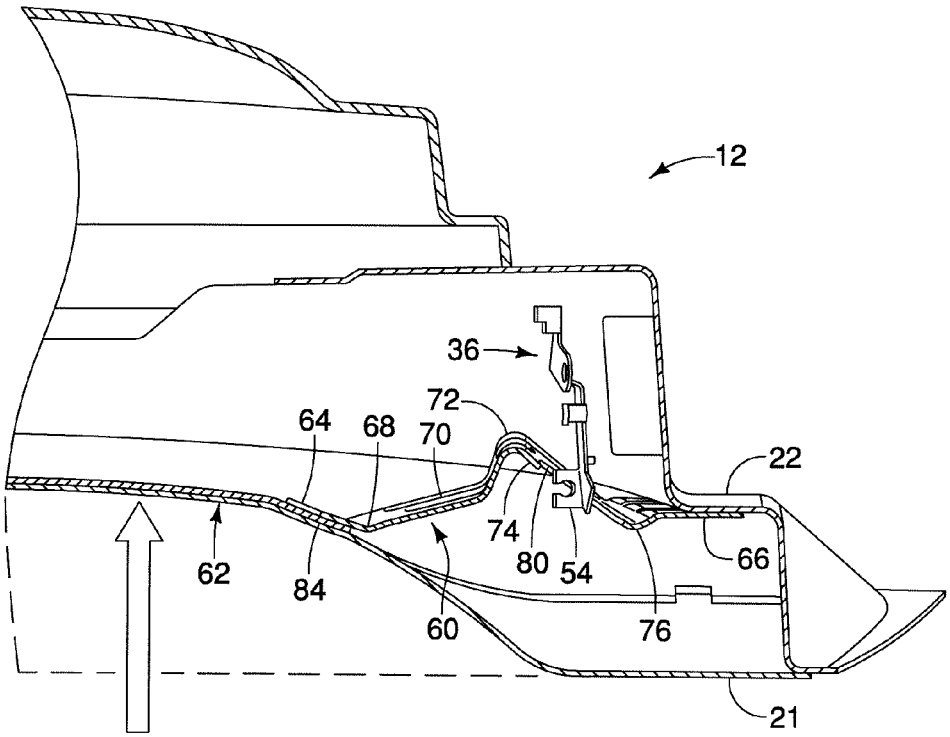
FIG. 5 is a simplified horizontal cross-sectional view of a rear portion of the vehicle door with selected parts removed to more clearly illustrate the door latch mechanism and the door latch engagement bracket with the main latch release lever passing into the opening of the door latch engagement bracket, after an impact force has acted on the outer panel of the vehicle door to plastically deform the door latch engagement bracket.

As best seen in FIGS. 3 to 5, the vehicle door 12 basically includes an outer door panel 21, an inner door panel 22, a door latch mechanism 24, an inside door release handle 26 and an outside door release handle 28. These components of the vehicle door 12 also constitute part of the vehicle door latch structure 14 of the illustrated embodiment. The outer and inner door panels 21 and 22 are typically sheet metal members that are stamped and fixedly secured together by a suitable fastening technique such as welding, adhesive, fasteners, etc. Basically, the outer and inner door panels 21 and 22 define the hollow interior for housing the door latch mechanism 24 as well as other various door elements and/or mechanisms that are well known in the art. The door latch mechanism 24 is operated by the inside door release handle 26 and the outside door release handle 28 in a conventional manner.

Figure 6:
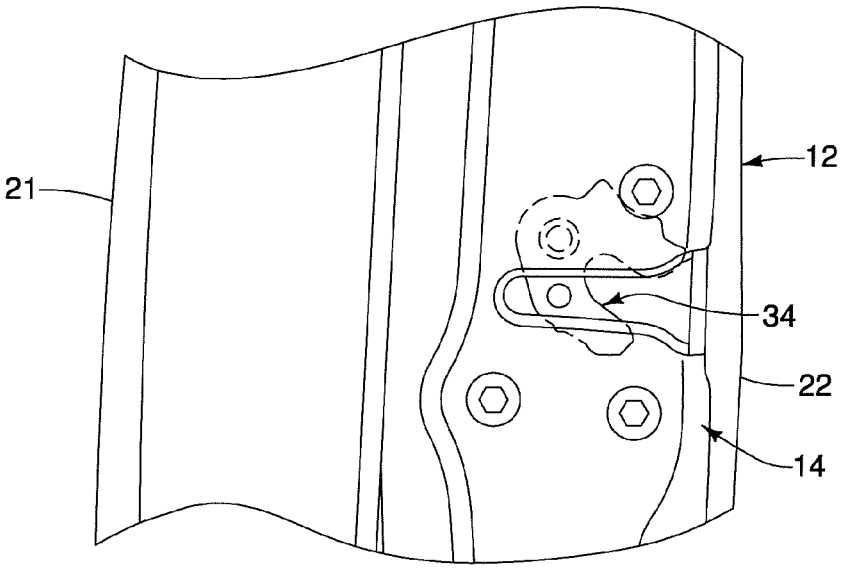
FIG. 6 is an enlarged rear end elevational view of a portion of the vehicle door that includes the vehicle door latch structure.
Figure 7:
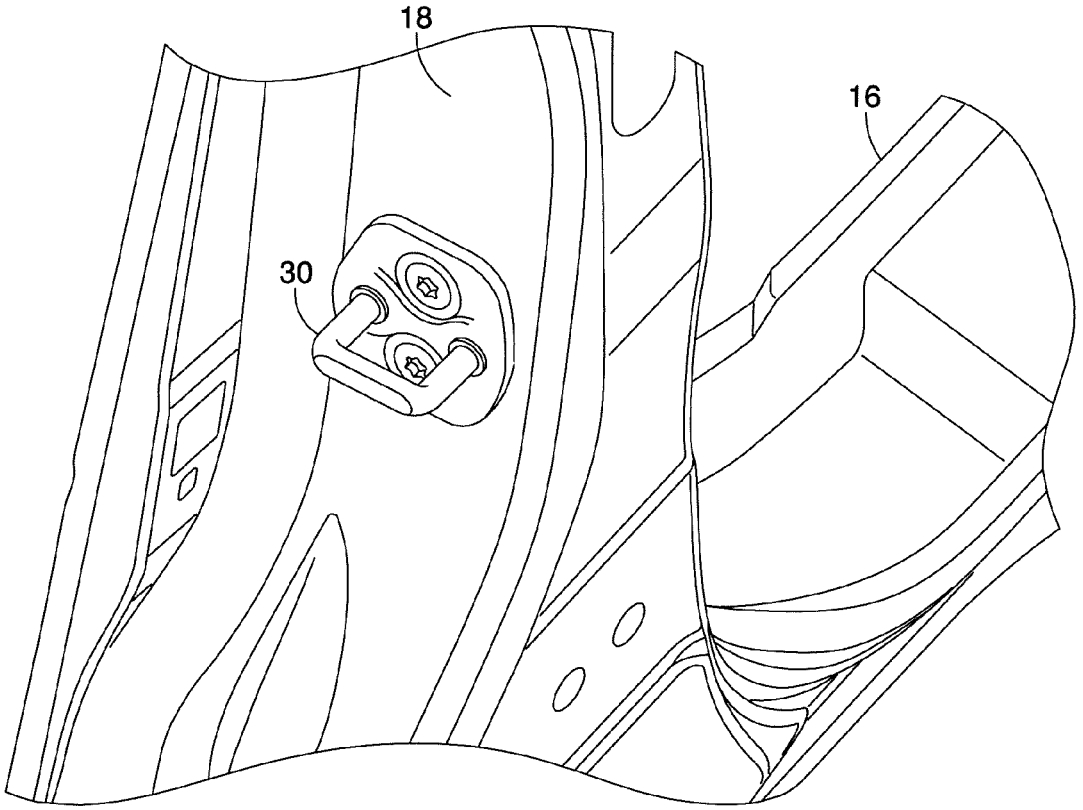
FIG. 7 is an enlarged perspective view of a portion of the B-pillar that includes the striker for the vehicle door latch structure.

As seen in FIGS. 6 and 7, the door latch mechanism 24 (FIG. 6) secures a rearward end of the vehicle door 12 to a striker 30 (FIG. 7) that is provided on the B-pillar 18 in a releasable manner. The inside door release handle 26 and the outside door release handle 28 are operated in a conventional manner to release the door latch mechanism 24 from the striker 30 so that the vehicle door 12 can pivot from the closed (latched) position to the open (unlatched) position. In this way, the vehicle door 12 can be selectively latched to the striker 30 by the door latch mechanism 24, and then selectively released from the striker 30 by operating the door latch mechanism 24 with one of the door release handles 26 and 28 such that the vehicle door 12 can pivot from the closed (latched) position to the open (unlatched) position.

The door latch mechanism 24 is relatively conventional, and thus, will only be discussed as needed to understand the inadvertent unlatching prevention feature 20 of the vehicle door latch structure 14. Referring collectively to FIGS. 8 to 18, the door latch mechanism 24 basically includes, among various other parts that are not shown, a mounting member 32, a door latch 34, an outside door latch release lever 36, a connecting member 38, an inside door latch release lever 40 and a latch retaining member 42. The door latch 34 of the door latch mechanism 24 selectively latches the vehicle door 12 to the striker 30 provided on the B-pillar 18 for holding the vehicle door 12 in the closed position. Basically, the outside door latch release lever 36 is connected to the latch retaining member 42 by the connecting member 38. Operation of either of the door release handles 26 and 28 pivots the outside door latch release lever 36 which in turn pulls the connecting member 38 to pivot the latch retaining member 42 out of engagement with the latch 34 for moving the latch 34 from the latched position to unlatched position. The door latch 34 is engaged with the striker 30 by closing the vehicle door 12, which causes the striker 30 to contact and rotate the door latch 34 back to the latched position where the latch retaining member 42 is biased back into engagement with the door latch 34.

A simplified version of the door latch mechanism 24 will be illustrated for the sake of simplicity, since the inadvertent unlatching prevention feature 20 of the vehicle door latch structure 14 can be used with any door latch mechanism that includes an exposed-type latch. For example, in this simplified version of the door latch mechanism 24, the connecting member 38 is illustrated as a single member that is movably arranged to move the door latch 34 in response to operation of one of the door latch release levers 36 and 40. In most cases, the connecting member 38 is a much more elaborate mechanism, which includes an inside door lock. In any event, the door latch 34 and the outside door latch release lever 36 are mechanically connected together.

Figure 16:
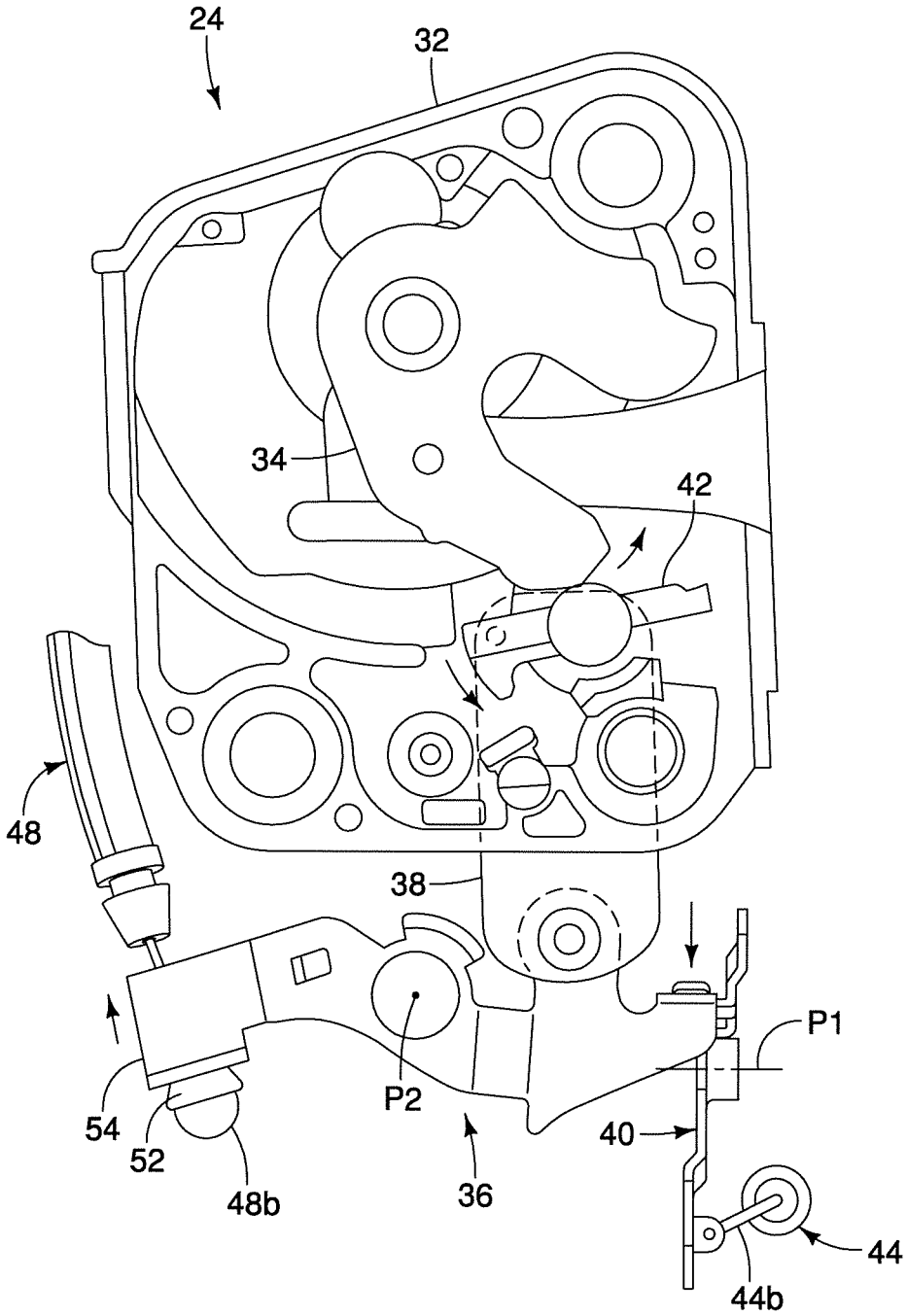
FIG. 16 is an enlarged rear elevational view of the door latch mechanism of the vehicle door latch structure in the released position.

The mounting member 32 is fixed to a door jamb portion of the inner door panel 22 with the door latch 34 pivotally mounted on the mounting member 32 between a latched position (FIG. 15) and an unlatched position (FIG. 16). In the unlatched or released position, the door latch 34 is oriented to receive the striker 30 to latch the vehicle door 12 to the B-pillar 18 upon swinging the vehicle door 12 from the opened position to the closed position. In other words, when the vehicle door 12 is being closed, the door latch 34 hits the striker 30, which causes the door latch 34 to pivot from the unlatched position to the latched position such that the door latch 34 latches the striker 30 to hold the vehicle door 12 closed against the B-pillar 18. Once the vehicle door 12 is closed, either one of the door release handles 26 and 28 can be operated in a conventional manner to release the door latch 34 from the striker 30 so that the vehicle door 12 can pivot from the closed (latched) position to the open (unlatched) position. In the unlatched position, the door latch 34 is oriented to release the striker 30 to release the vehicle door 12 from the B-pillar 18 such that the vehicle door 12 can be opened. While the vehicle door 12 is opened, the door latch 34 is normally oriented in the unlatched position. The door latch 34 is biased to the unlatched position by a release spring (not shown).

Referring now to FIGS. 8 to 18, the inside door release handle 26 and the outside door release handle 28 are movably mounted to the vehicle door 12 such that when they are moved from their rest positions to their door handle release positions, the door latch 34 is released to move from the latched position to the unlatched position due to an urging force of the release spring (not shown). Each of the door release handles 26 and 28 includes a return spring (not shown) for biasing the door release handles 26 and 28 to their rest position.

Figure 8:
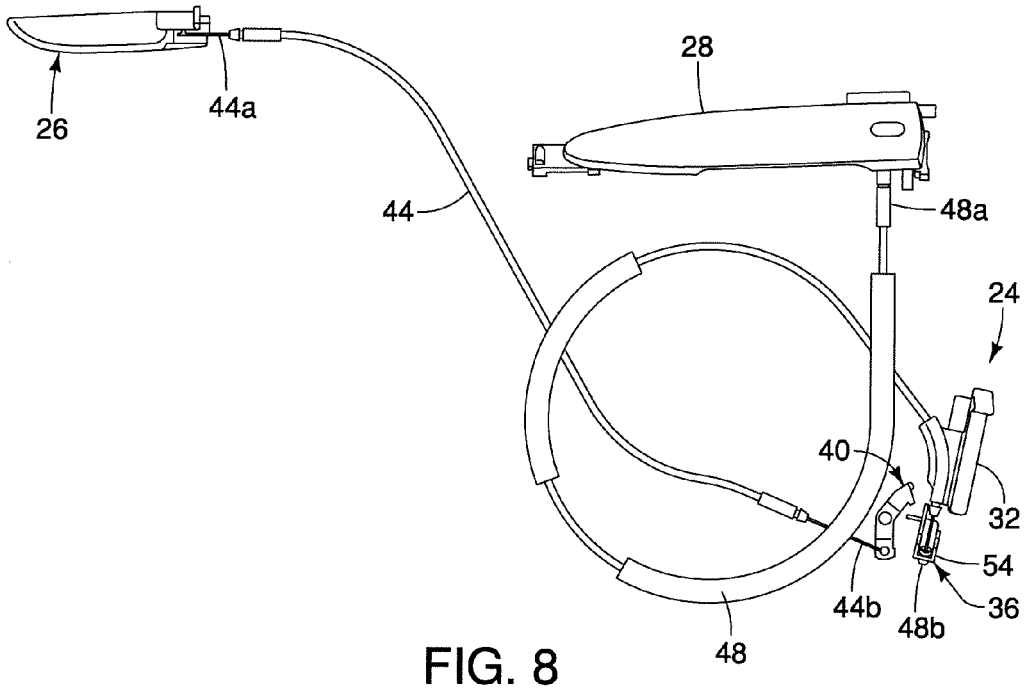
FIG. 8 is a side elevational view of the door release handles and the door latch mechanism of the vehicle door latch structure.
Figure 9:
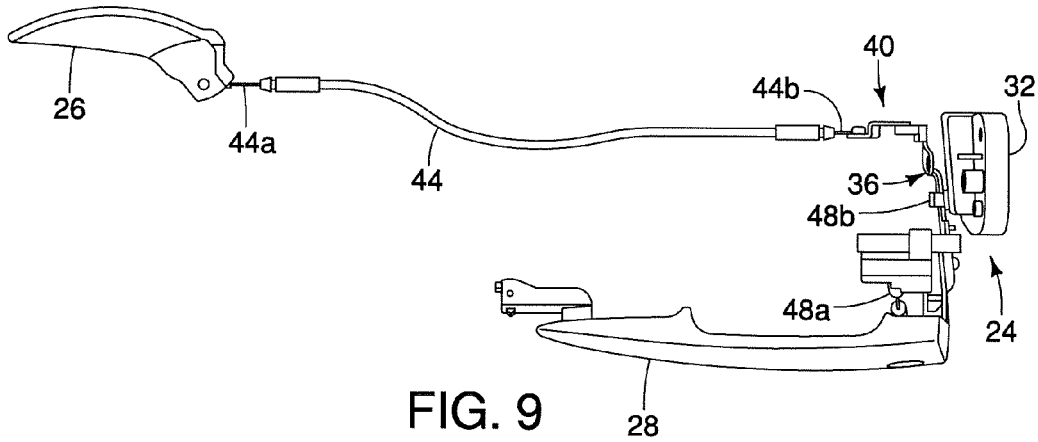
FIG. 9 is a top plan view of the door release handles and the door latch mechanism of the vehicle door latch structure.
Figure 10:
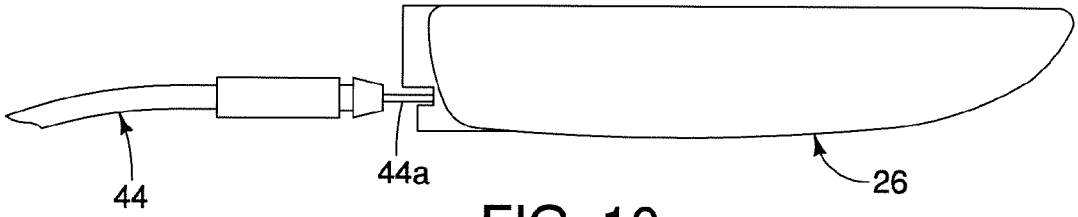
FIG. 10 is an inside elevational view of the inside door release handle of the vehicle door latch structure.
Figure 11:
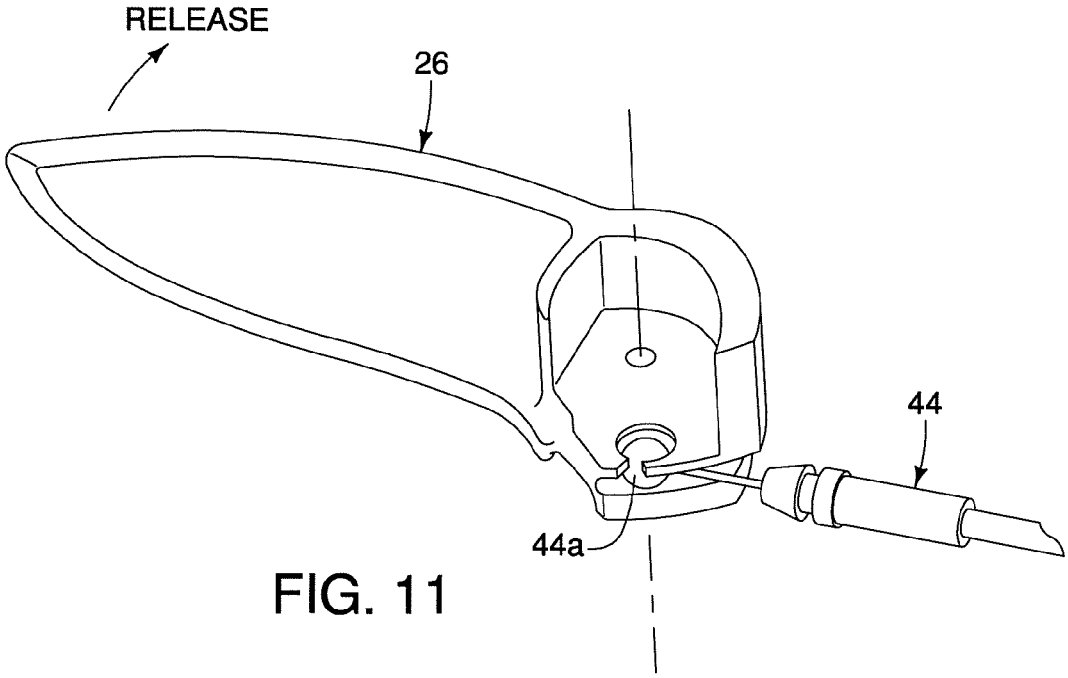
FIG. 11 is an enlarged perspective view of the inside door release handle of the vehicle door latch structure.

In the illustrated embodiment, as seen in FIGS. 8 to 10, the inside door release handle 26 is operatively coupled to the inside door latch release lever 40 of the door latch mechanism 24 by an inside door latch release cable 44 for releasing the door latch 34. In particular, the cable 44 has a first end 44*a* fixed to the inside door release handle 26 and a second end 44*b* fixed to the inside door latch release lever 40. Thus, the inside door release handle 26 is remotely spaced from and operatively coupled to the door latch mechanism 24 by the inside door latch release cable 44. The outside door release handle 28 is operatively coupled to the door latch 34 by an outside door latch release cable 48 for releasing the door latch 34. The outside door latch release cable 48 has a first end 48*a* fixed to the outside door release handle 28 and a second end 48*b* fixed to the outside latch release lever 36. Thus, the outside door release handle 28 is remotely spaced from and operatively coupled to the door latch mechanism 24 by the outside door latch release cable 48.

Since the inside door latch release lever 40 acts on the outside latch release lever 36 to move the door latch 34 from the unlatched position to the latched position, the outside latch release lever 36 will hereinafter be called the main latch release lever 36. In particular, by pivoting the inside door release handle 26 in an inward direction into the vehicle interior from a rest position to a door handle release position, the inside door latch release cable 44 pulls the inside door latch release lever 40 such that the inside door latch release lever 40 pivot about its pivot axis P1 into contact with the main latch release lever 36. This contact of the inside door latch release lever 40 against the main latch release lever 36 causes the main latch release lever 36 to pivot about its pivot axis P2 in a first pivot direction and thus, pivots the door latch 34 to the unlatched position via the connecting member 38. The inside door latch release lever 40 is biased to its rest position by the return spring of the inside door release handle 26. The main latch release lever 36 is biased to its rest position by a return spring in the door latch mechanism 24. In the illustrated embodiment, the main latch release lever 36 and the inside door latch release lever 40 are pivotally mounted in a housing (not shown) of the door latch mechanism 24 that is fixed to the inner door panel 22. However, depending on the type of latch mechanism used and its arrangement within the vehicle door 12, the main latch release lever 36 and the inside door latch release lever 40 can be pivotally mounted on the outer door panel 21.

Figure 12:
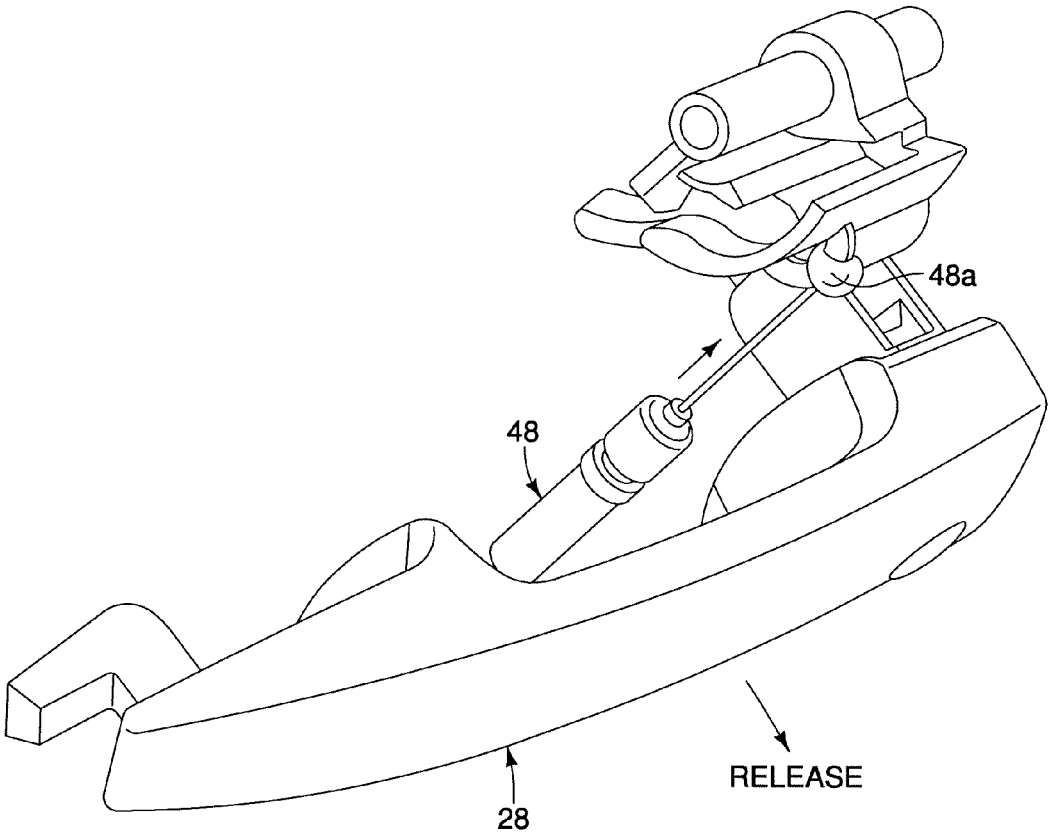
FIG. 12 is an enlarged perspective view of the outside door release handle of the vehicle door latch structure.
Figure 14:
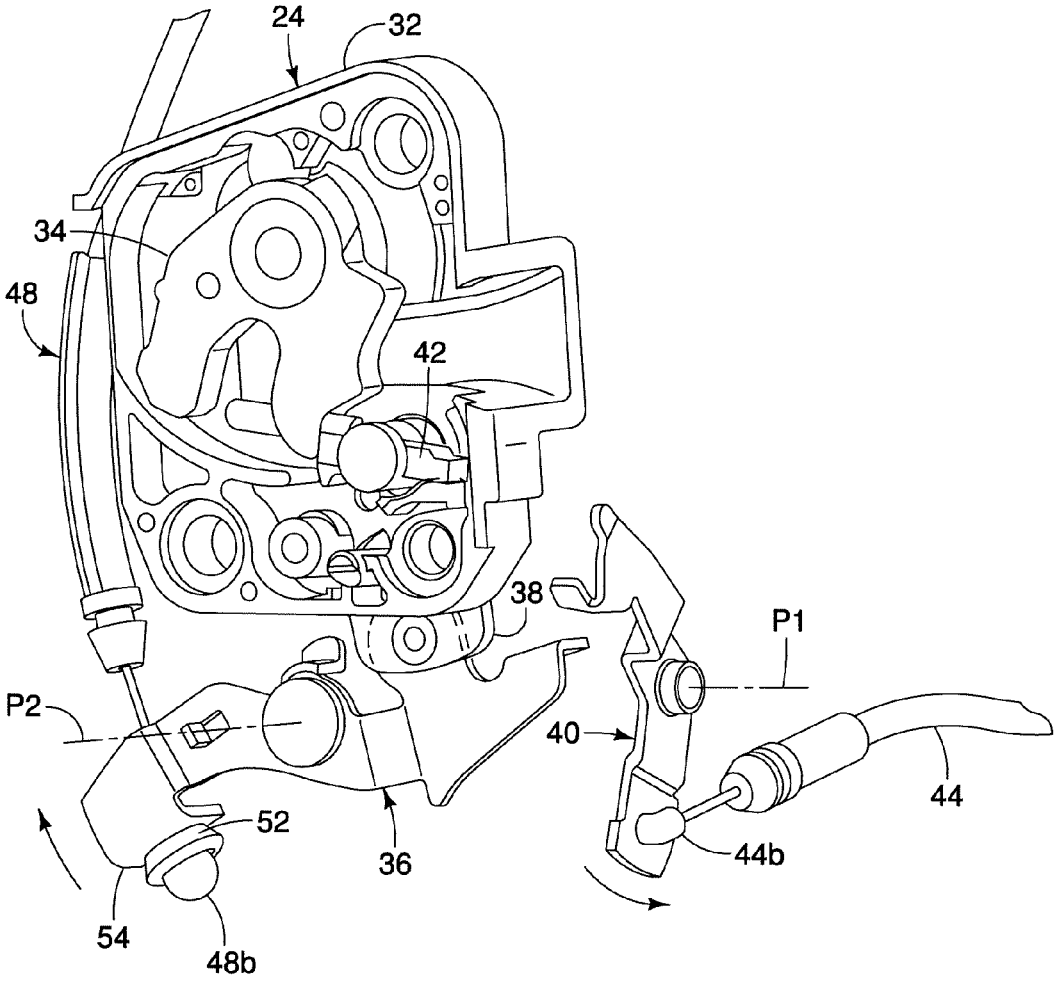
FIG. 14 is an enlarged rear perspective view of the door latch mechanism of the vehicle door latch structure.
Figure 15:
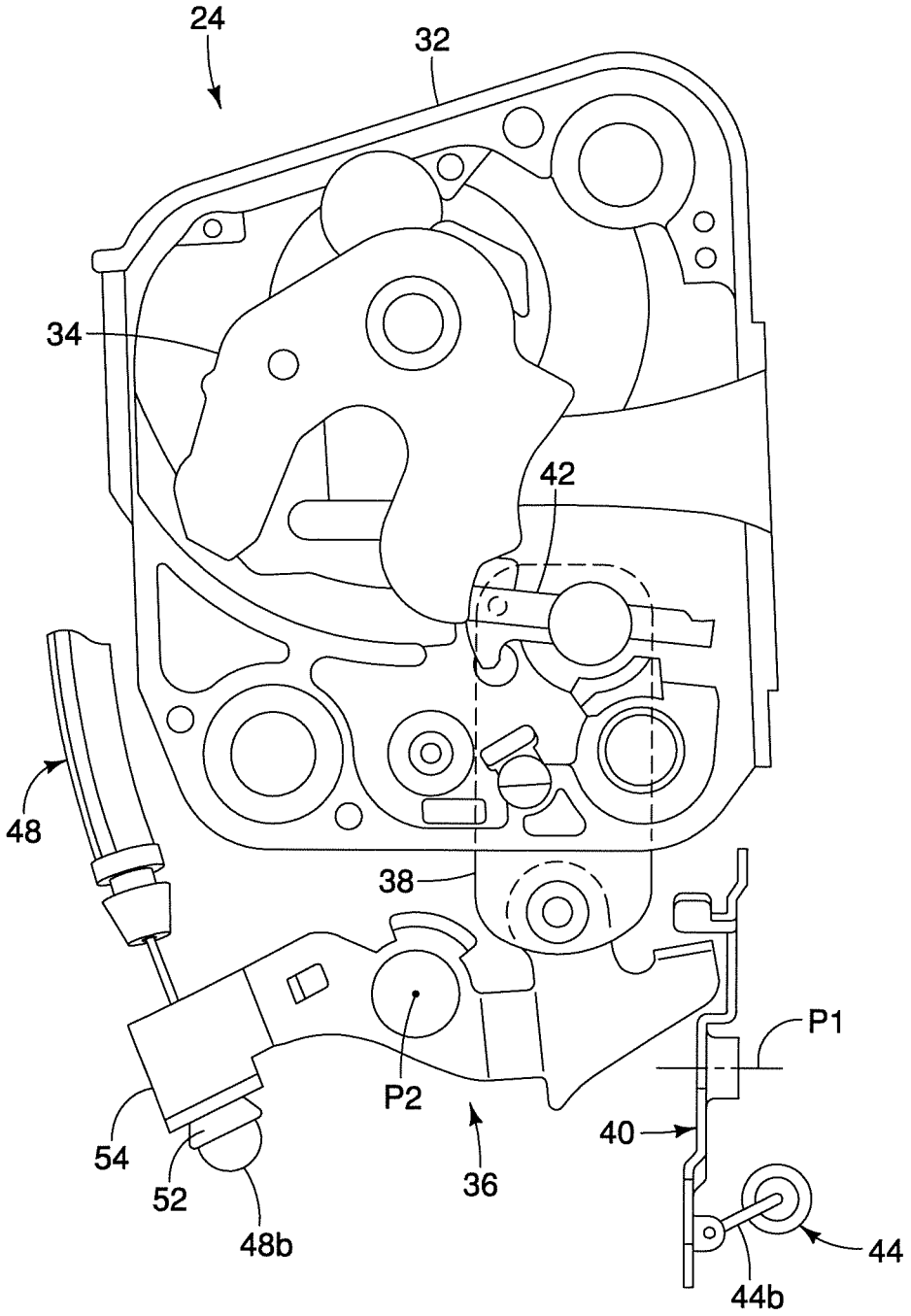
FIG. 15 is an enlarged rear elevational view of the door latch mechanism of the vehicle door latch structure in the rest position.

In addition to the main latch release lever 36 being operated by the inside door release handle 26 via the inside door latch release cable 44 and the inside door latch release lever 40, the main latch release lever 36 is also operated by the outside door release handle 28 via the outside door latch release cable 48. The outside door release handle 28 can be best seen in FIGS. 8, 9 and 12. As mentioned above, the outside door release handle 28 is remotely spaced from and operatively coupled to the door latch 34 of the door latch mechanism 24 by the outside door latch release cable 48. As best seen in FIG. 12, the first end 48*a* of the latch release cable 48 is attached to the outside door release handle 28. As best seen in FIG. 14, the second end 48*b* of the outside door latch release cable 48 is attached to the main latch release lever 36. In the illustrated embodiment, the outside door latch release cable 48 includes a latch cable retaining member 52 (e.g., a grommet) coupling the second end 48*b* of the latch release cable 48 to a cable attachment part 54 (e.g., a flange with a cutout) the main latch release lever 36. By pivoting the outside door release handle 28 in an outward direction away from the outer door panel 24 from the rest position to a door handle release position, the outside door latch release cable 48 pulls the main latch release lever 36 such that the main latch release lever 36 pivots about its pivot axis P2 in a pivot direction such that operation of the main latch release lever 36 pivots the door latch 34 to the unlatched position via the connecting member 38. The main latch release lever 36 moves the latch retaining member 42 via the connecting member 38 so that a biasing force can move the door latch 34 toward the unlatched position. Due to the sliding connection of the outside door latch release cable 48 to the main latch release lever 36 by the latch cable retaining member 52, the movement of the main latch release lever 36 by the inside door latch release lever 40 does not cause the outside door release handle 28 to pivot in response to operation of the inside door release handle 26.

Figure 17:
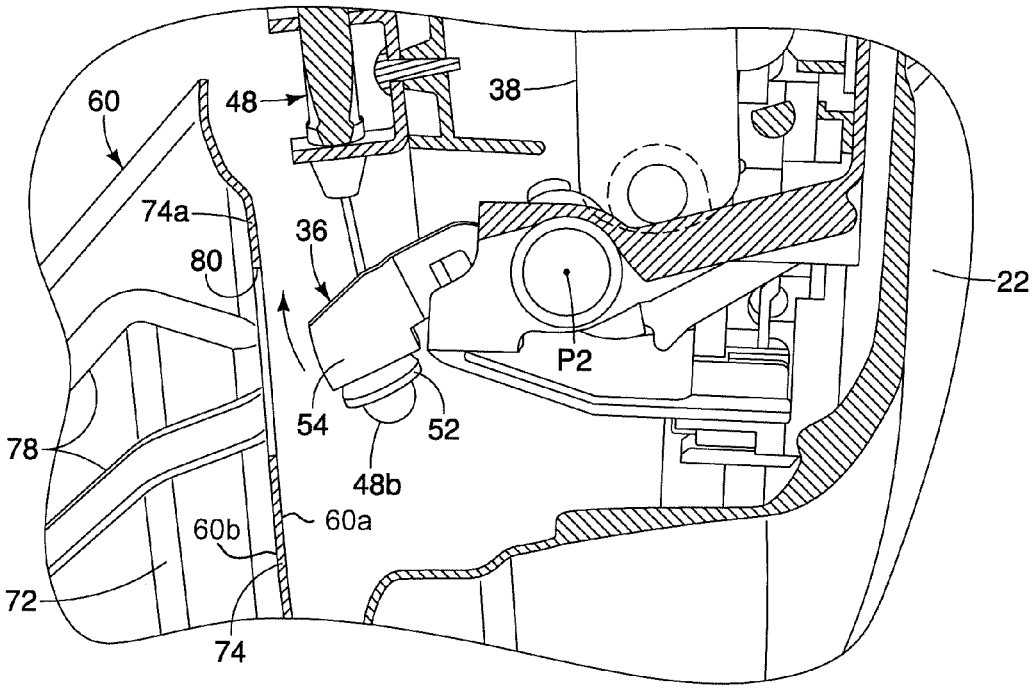
FIG. 17 is a cross-sectional view of the door latch mechanism and the door latch engagement bracket with the main latch release lever in the rest position.
Figure 18:
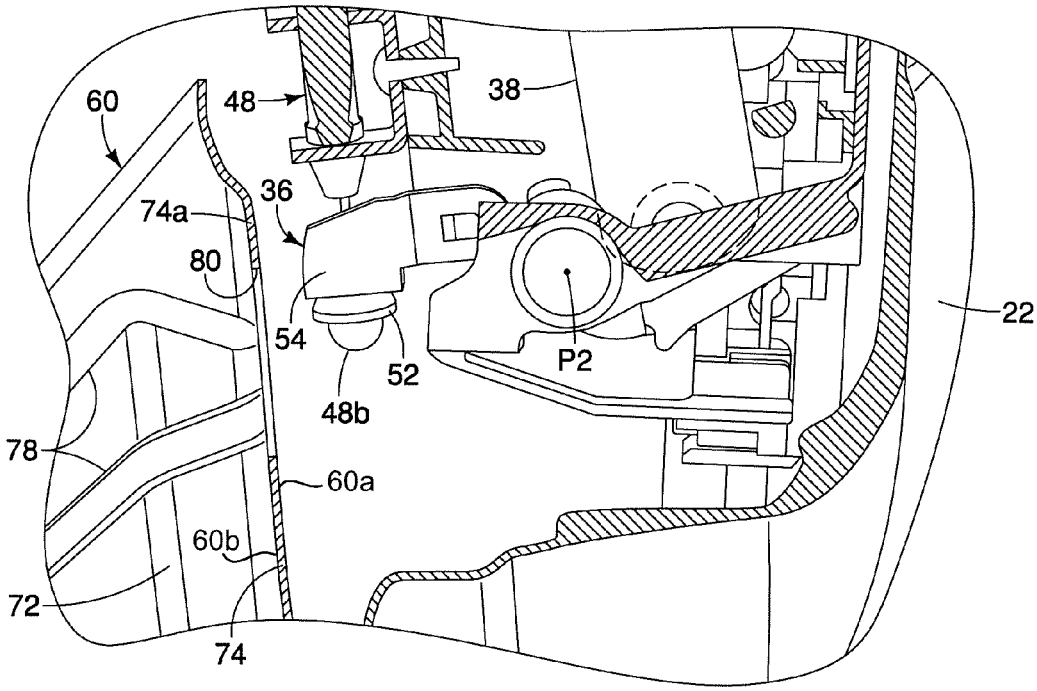
FIG. 18 is a cross-sectional view of the door latch mechanism and the door latch engagement bracket with the main latch release lever in the release position.
Figure 19:
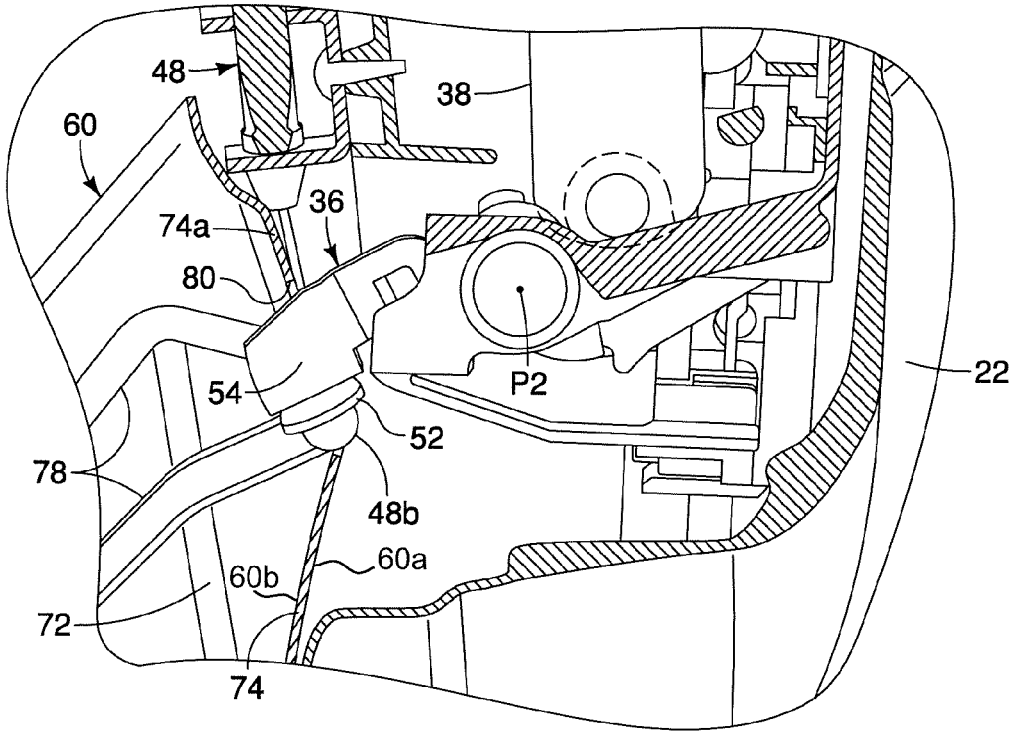
FIG. 19 is a cross-sectional view of the door latch mechanism and the door latch engagement bracket with the main latch release lever in the rest position, after an impact force has acted on the outer door panel to plastically deform the door latch engagement bracket such that the main latch release lever passes into the opening of the door latch engagement bracket.
Figure 20:
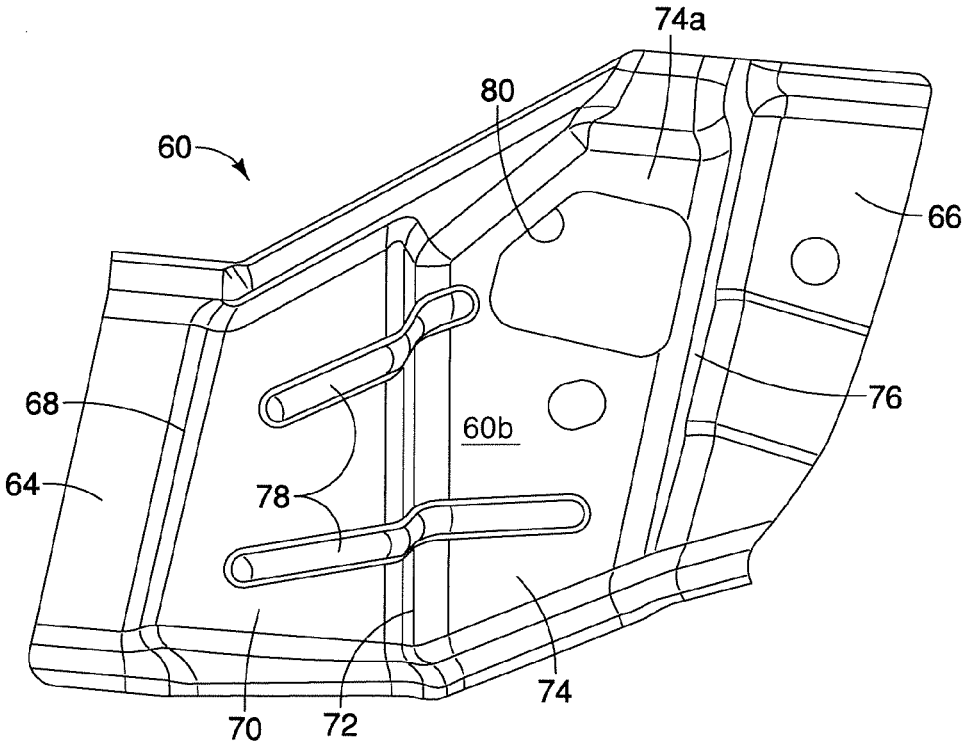
FIG. 20 is an outside side elevational view of the door latch engagement bracket.
Figure 21:
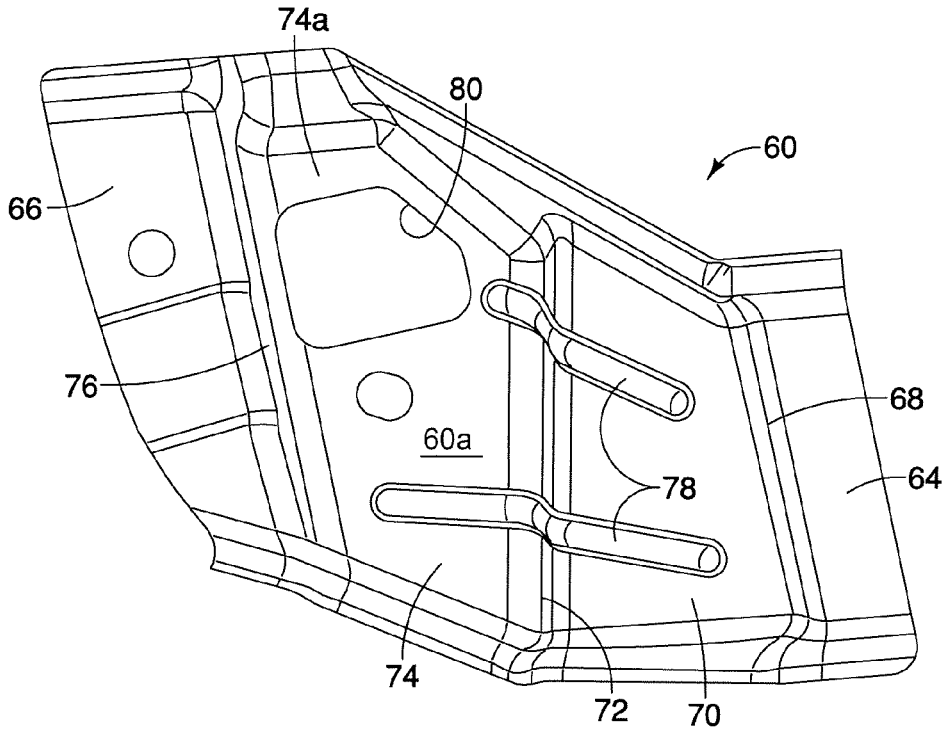
FIG. 21 is an inside side elevational view of the door latch engagement bracket.
Figure 22:
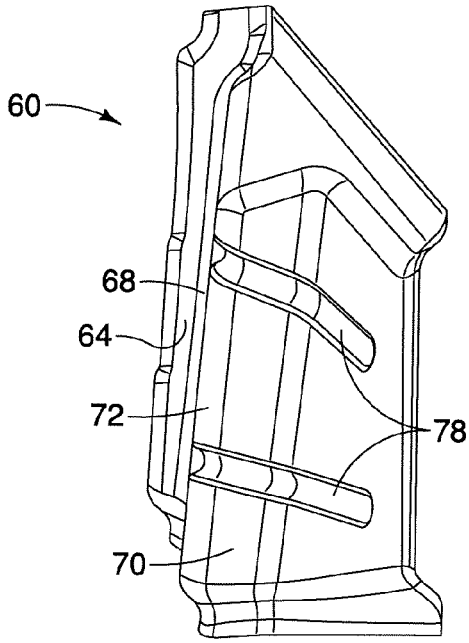
FIG. 22 is a front end elevational view of the door latch engagement bracket.
Figure 23:
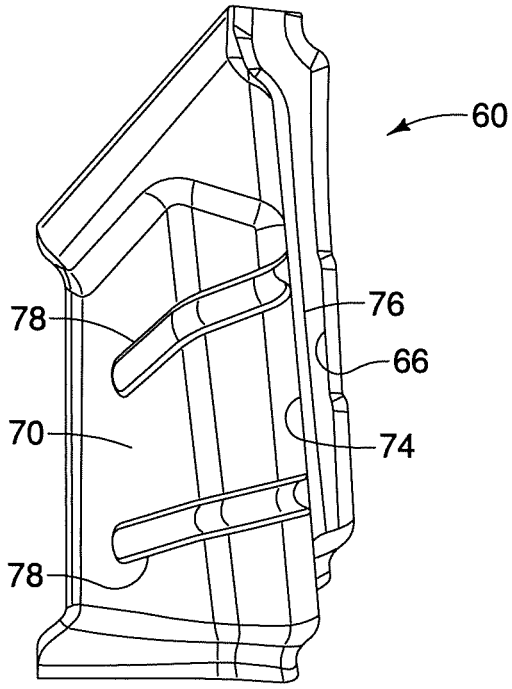
FIG. 23 is a rear end elevational view of the door latch engagement bracket.
Figure 24:
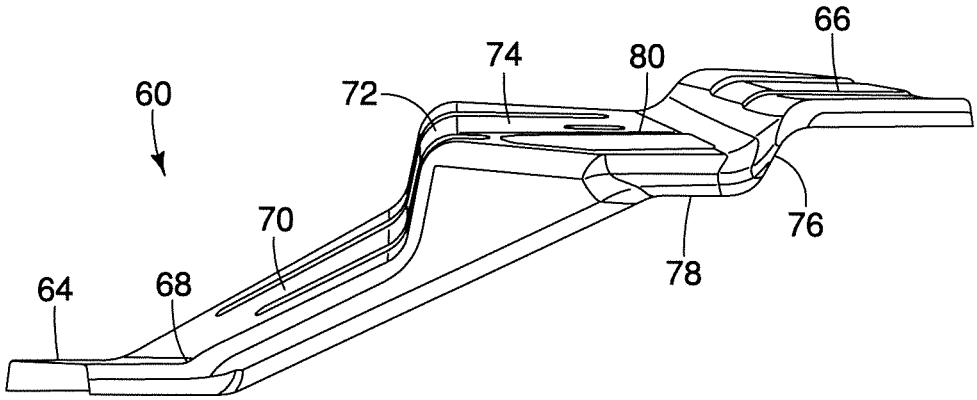
FIG. 24 is a top plan view of the door latch engagement bracket.

As mentioned above, the main latch release lever 36 is of an exposed-type latch in which the cable attachment part 54 is exposed from a housing (not shown) of the latch mechanism 24 that pivotally supports the main latch release lever 36. The cable attachment part 54 is formed at a distal end of the latch release lever 36 that is closest to the outer door panel 21. In this embodiment, the cable attachment part 54 is L-shaped with a cutout for receiving the latch cable retaining member 52. The main latch release lever 36 is movably arranged along a latch release lever movement path between a rest position and a release position as best seen in FIGS. 17 and 18. In the illustrated embodiment, the main latch release lever 36 pivots between the rest position (FIG. 17) and the release position (FIG. 18). The main latch release lever 36 is biased to its rest position by the return spring of the door latch mechanism 24. The door latch mechanism 24 is oriented such that the main latch release lever 36 moves primarily in a vertical direction between the rest position and the release position. The main latch release lever 36 moves along the latch release lever movement path between its rest position and its release position in response to a door releasing operation of the door latch mechanism 24 by either of the door release handles 26 and 28.

The door latch mechanism 24 can be provided with other conventional features as needed and/or desired. For example, in the case of front doors such as the vehicle door 12, a key-operated lock is typically provided to lock the door latch 34 in the latched position. Since key-operated locks are relatively conventional and optional such as in the case of rear doors, the addition of a key-operated lock will not be discussed or illustrated herein.

In the illustrated embodiment, the vehicle door latch structure 14 further includes a door latch engagement bracket 60 and a door reinforcement member 62. The door latch engagement bracket 60 and the door reinforcement member 62 are located between the inner door panel 20 and the outer door panel 22, with the door latch engagement bracket 60 and the door reinforcement member 62 being disposed closer to the outer door panel 22 than to the inner door panel 20. The door latch engagement bracket 60 is disposed adjacent to the main latch release lever 36. In this embodiment, the door latch engagement bracket 60 and the door reinforcement member 62 are fixed together to form an intermediate structural reinforcement bar of the vehicle door 12. The door latch engagement bracket 60 and the door reinforcement member 62 are vertically located in the middle third of the vehicle door 12 in the illustrated embodiment.

The door latch structure 14 is provided with the door latch engagement bracket 60 to prevent inadvertent unlatching of the door latch 34 from the striker 30. The door latch engagement bracket 60 and the door reinforcement member 62 are vertically aligned in the vehicle door 12 with the main latch release lever 36 such that the door latch engagement bracket 60 overlaps with the main latch release lever 36 as viewed in a horizontal direction with respect to the vehicle door 12. The door latch engagement bracket 60 crushes on impact to surround the main latch release lever 36 for preventing the main latch release lever 36 from moving enough to cause an unlatched condition. The door latch engagement bracket 60 and the door reinforcement member 62 cooperate together to form an inadvertent unlatching prevention feature 20 for preventing the vehicle door 12 from inadvertently moving from the closed (latched) position to the open (unlatched) position in response to an impact event that deforms the vehicle door 12.

The door latch engagement bracket 60 has an inner facing side with an inner facing side surface 60*a* that faces the main latch release lever 36, and an outer facing side opposite the inner facing side with an outer facing side surface 60*b* that faces away from the main latch release lever 36. The door latch mechanism 24 has an original installed state (i.e., prior to an impact event) in which the main latch release lever 36 is entirely disposed on the inner facing side of the door latch engagement bracket 60. In the case of a side impact event in which the door latch engagement bracket 60 is deformed in an inbound direction of the vehicle door 12, the door latch mechanism 24 attains a restricted state in which at least a portion of the main latch release lever 36 is located past the outer facing side surface of the door latch engagement bracket 60. More specifically, as the door latch engagement bracket 60 is moved toward the door latch mechanism 24, it deforms from the installed state to the restricted state. During this deformation, the distal end (cable attachment part 54) of the main latch release lever 36 passes from the inner facing side of the door latch engagement bracket 60, through the opening 80, until the distal end of the main latch release lever 36 is located past the outer facing side surface 60*b*.

The door latch engagement bracket 60 and the door reinforcement member 62 are connected together to function as the inadvertent unlatching prevention feature 20. However, the door latch engagement bracket 60 can alternatively be a separate member that is not directly attached to the door reinforcement member 62, but rather the door latch engagement bracket 60 is disposed adjacent the door reinforcement member 62 such that the door latch engagement bracket 60 deforms in response to the door reinforcement member 62 being pushed inward towards the inner door panel 22. Moreover, while the door latch engagement bracket 60 and the door reinforcement member 62 are illustrated as being separate members that are fixed together, it will be apparent from this disclosure that the door latch engagement bracket 60 and the door reinforcement member 62 can be formed as a one-piece, unitary member such as a single stamped sheet metal member.

Now the door latch engagement bracket 60 will be discussed in further detail. The door latch engagement bracket 60 is best illustrated in FIGS. 20 to 24. In this illustrated embodiment, the door latch engagement bracket 60 is formed as a one-piece, unitary member such as a single stamped sheet metal member. Of course, other suitable materials can be utilized as needed or desired. The precise configuration of the door latch engagement bracket 60 will depend on the particular construction of the vehicle door 12. The door latch engagement bracket 60 is located in the vehicle door 12 between the door panels 21 and 22, with the door latch engagement bracket 60 being closer to the outer door panel 21 than to the inner door panel 22. However, the door latch engagement bracket 60 is spaced apart from the outer door panel 21 far enough so that contact can be prevented between the main latch release lever 36 and the outer door panel 21 during normal use.

The door latch engagement bracket 60 includes a reinforcement attachment flange 64 and a door panel attachment flange 66. The reinforcement attachment flange 64 is attached to the door reinforcement member 62 and the door panel attachment flange 66 is attached to one of the door panels 21 and 22 (e.g., the door panel attachment flange 66 is attached to the inner door panel 22 in this illustrated embodiment). As can best be determined from FIGS. 4 and 24, the reinforcement attachment flange 64 and the door panel attachment flange 66 are offset from each other such that the reinforcement attachment flange 64 is more outbound than the door panel attachment flange 66 within the vehicle door.

The door latch engagement bracket 60 further includes a first transition part 68, an inclined part 70, a second transition part 72, a release lever restricting part 74 and a third transition part 76. The first transition part 68 is basically a bend that connects the reinforcement attachment flange 64 to the inclined part 70. The second transition part 72 is basically a bend that connects the inclined part 70 to the release lever restricting part 74. The third transition part 76 is basically a bend that connects the release lever restricting part 74 to the door panel attachment flange 66. Two stiffening ribs 78 extend along portions of the inclined part 70, the second transition part 72 and the release lever restricting part 74. The release lever restricting part 74 includes an opening 80 (cutout section) for receiving the main latch release lever 36 in the event of a side impact that deforms the vehicle door 12. Stated differently, the release lever restricting part 74 includes a peripheral wall 74*a* that at least partially defines the opening 80 for receiving the main latch release lever 36 in the event of a side impact that deforms the vehicle door 12. In this embodiment, the peripheral wall 74*a* of the release lever restricting part 74 restricts movement of the main latch release lever 36 by the peripheral wall 80*a* engaging the cable attachment part 54 of the main latch release lever 36.

The release lever restricting part 74 (e.g., the peripheral wall 74*a* defining at least an upper portion of the opening 80) engages the main latch release lever 36 to prevent movement of the main latch release lever 36 from the rest position to the release position. In this embodiment, the peripheral wall 74*a* defining the upper portion of the opening 80 completely surrounds the opening 80 to define an aperture in the door latch engagement bracket 60. The opening 80 is aligned with the main latch release lever 36 while the main latch release lever 36 is in the rest position. In this way, the main latch release lever 36 extends through the opening 80 upon movement of the door latch engagement bracket 60 toward the door latch mechanism 24 while the main latch release lever 36 is in the rest position. As a result, the door latch engagement bracket 60 prevents movement of the main latch release lever 36 from the rest position to the release position while the main latch release lever 36 is extending through the opening 80 in the door latch engagement bracket 60.

In particular, as seen in FIGS. 2 to 5, and 17 to 19, the opening 80 in the door latch engagement bracket 60 is designed to engage the main latch release lever 36 in a side impact and restrict the movement of the main latch release lever 36 for preventing the door 12 from becoming unlatched. The main latch release lever 36 is not covered in a casing (exposed to the intruding door during a side impact) and is connected to the door latch 34. Substantial vertical movement of this latch release lever unlocks the door. The opening 80 in the door latch engagement bracket 60 lets the main latch release lever 36 pass through the door latch engagement bracket 60 and the edges of this opening 80 restrict movement of the main latch release lever 36 in a vertical direction. However, the opening 80 can be oriented and dimensioned in several ways to account for the various lever latch movements, including vertical (traditionally) movement and horizontal movement. In the illustrated embodiment, the release lever restricting part 74 is aligned with the latch release lever movement path of the main latch release lever 36 such that the release lever restricting part 74 becomes disposed in the latch release lever movement path upon movement of the door latch engagement bracket 60 toward the door latch mechanism 24 to block movement of the main latch release lever 36 along the movement path. In other words, the release lever restricting part 74 is aligned with the latch release lever movement path and the opening 80 is aligned with the main latch release lever 36 while the main latch release lever 36 is in the rest position. This will prevent the door 12 from inadvertently unlatching in the event of a side impact that deforms the vehicle door 12.

During an impact event, the main latch release lever 36 passes through the opening 80 with no or minimal contact with the peripheral wall 74*a* that defines at least the upper portion of the opening 80. In this way, the door latch engagement bracket 60 restricts movement of the main latch release lever 36 without significantly deforming and/or significantly damaging the main latch release lever 36. The peripheral wall 74*a* defining the upper portion of the opening 80 is arranged and dimensioned to prevent movement of the main latch release lever 36 to a degree that would cause an unlatched condition.

The stiffening ribs 78 add strength to the inclined part 70, the second transition part 72 and the release lever restricting part 74 to control the amount of deformation of the inclined part 70, the second transition part 72 and the release lever restricting part 74. The first and second transition parts 68 and 76 do not include stiffening ribs such that they function as controlled bending or plastic deformation parts of the door latch engagement bracket 60. Of course, the inclined part 70, the second transition part 72 and the release lever restricting part 74 may also deform during a side impact event. However, the stiffening ribs 78 limit deformation in these areas of the door latch engagement bracket 60 to aid in maintaining alignment of the opening 80 with the main latch release lever 36 during movement of the door latch engagement bracket 60 towards the door latch mechanism 24.

The door latch engagement bracket 60, especially the plastic deformation part, is configured to deform in response to a force moving the door latch engagement bracket 60 towards the door latch mechanism 24 such that the door latch engagement bracket 60 moves from an undeformed configuration to a deformed configuration with the main latch release lever 36 extending through the opening 80, and with the release lever restricting part 74 disposed in the latch release lever movement path for restricting movement of the main latch release lever 36 from the rest position to the release position while the door latch engagement bracket 60 is in the deformed configuration.

The configuration of the door latch engagement bracket 60 can eliminate the possibility of the door latch engagement bracket 60 moving the main latch release lever 36 due to rotation or deformation of the door latch engagement bracket 60 during the side impact event. By using the door latch engagement bracket 60 as disclosed herein, a very consistent engagement between the main latch release lever 36 and the door latch engagement bracket 60 can be attained. In other words, by using the door latch engagement bracket 60 as disclosed herein, the door latch engagement bracket 60 is less prone to variations in the deformation mode of the door latch engagement bracket 60. In this way, when the main latch release lever 36 engages the opening 80 (i.e., the main latch release lever 36 passes through the opening 80), the edges of the opening 80 in the door latch engagement bracket 60 prevent the movement of the main latch release lever 36 beyond a certain permitted travel based on the particular design of the door latch mechanism 24.

Figure 13:
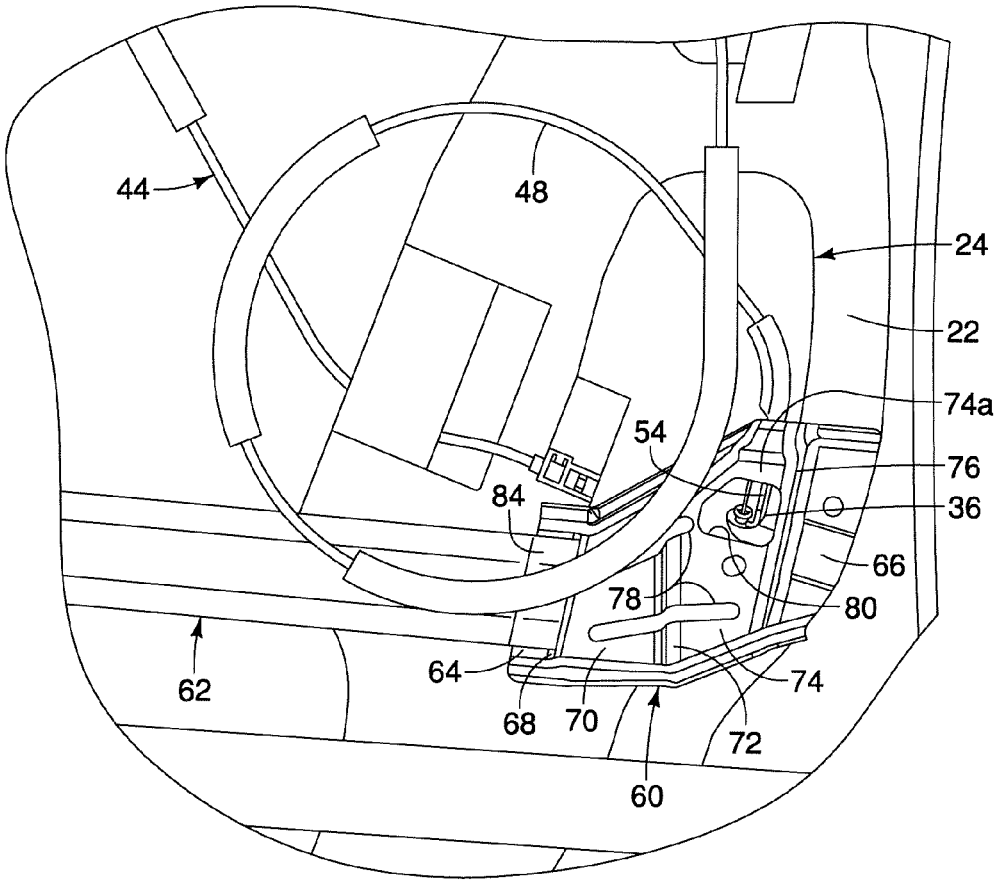
FIG. 13 is an enlarged elevational view of a portion of the vehicle door latch structure near the door latch engagement bracket.

Now the door reinforcement member 62 will be discussed in further detail. The door reinforcement member 62 is best illustrated in FIGS. 3, 4 and 13. In this illustrated embodiment, the door reinforcement member 62 is formed as a one-piece, unitary member such as a single stamped sheet metal member. The precise configuration of the door reinforcement member 62 will depend on the particular construction of the vehicle door 12. In the illustrated embodiment, the door latch engagement bracket 60 and the door reinforcement member 62 are stamped sheet metal members that are connected together so as to function as a part of an intermediate structural reinforcement bar and a latch restricting member. The door latch engagement bracket 60 and the door reinforcement member 62 form a stiff metal bar that strengthens a mid portion of the vehicle door 12 to minimize inward deflection of the vehicle door 12 into the vehicle cabin. The door reinforcement member 62 has a first attachment flange 82 attached to one of the door panels 21 and 22 (e.g., the first attachment flange 82 is attached to the inner door panel 22 in this illustrated embodiment) and a second attachment flange 84 attached to the reinforcement attachment flange 64 of the door latch engagement bracket 60.

Figure 25:
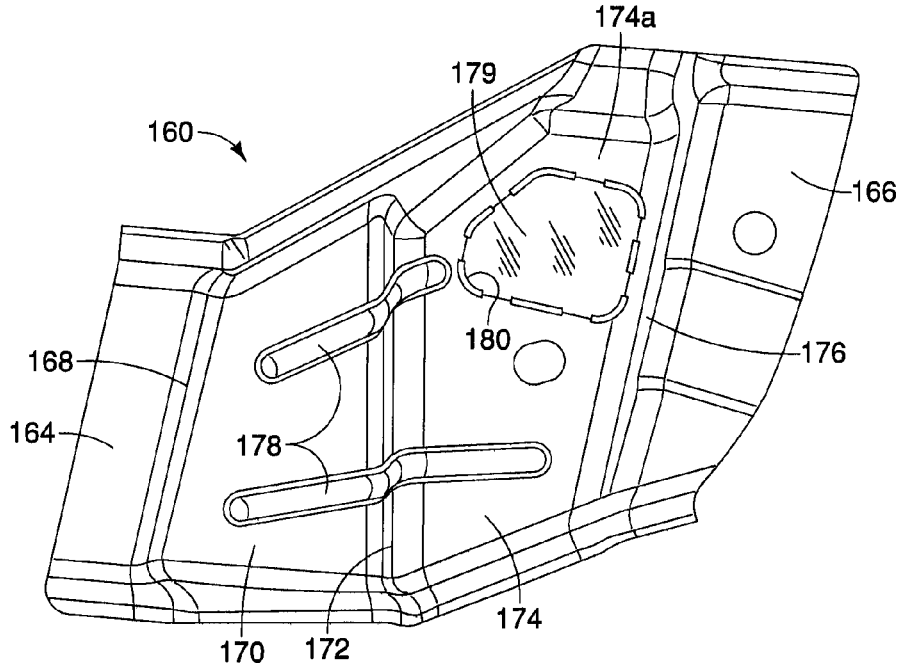
FIG. 25 is an outside side elevational view of another embodiment of a door latch engagement bracket.

Referring now to FIG. 25, a modified door latch engagement bracket 160 is illustrated in accordance with a second embodiment. The door latch engagement bracket 160 replaces the door latch engagement bracket 60 in the vehicle door 12 of the first embodiment. Similar to the door latch engagement bracket 60, the door latch engagement bracket 160 includes a reinforcement attachment flange 164, a door panel attachment flange 166, a first transition part 168, an inclined part 170, a second transition part 172, a release lever restricting part 174 and a third transition part 176. The only difference between the door latch engagement bracket 160 and the door latch engagement bracket 60 is the release lever restricting part 174. The door latch engagement bracket 160 also includes two stiffening ribs 178. The release lever restricting part 174 of the door latch engagement bracket 160 has a removable part 179 that is removed to form an opening 180. The removable part 179 is disposed within the opening 180 in its original state. The removable part 179 is removed from the opening 180 when the door latch engagement bracket 160 is moved towards the latch mechanism 24 and the main latch release lever 36 extends through the opening 180. The release lever restricting part 174 and the removable part 179 are integrally formed with a frangible seam surrounding the removable part 179 such that the release lever restricting part 174 includes a peripheral wall 174*a* that at least partially defines the opening 180, which is formed upon removal of the removable part 179. In view of the similarity between the first and second embodiments, further descriptions of the second embodiment have been omitted for the sake of brevity.

Figure 26:
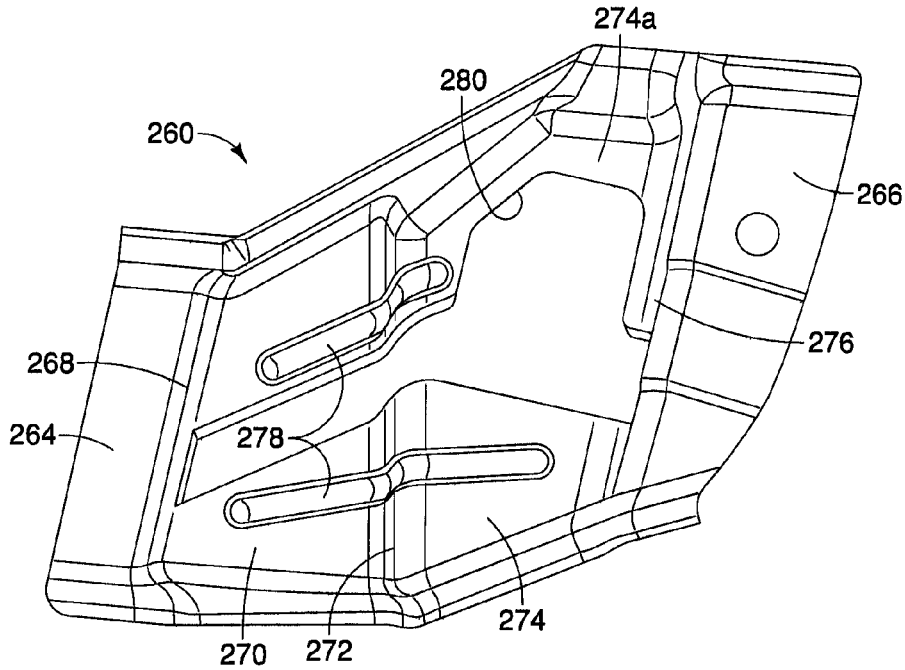
FIG. 26 is an outside side elevational view of another embodiment of a door latch engagement bracket.

Referring now to FIG. 26, a modified door latch engagement bracket 260 is illustrated in accordance with a third embodiment. The door latch engagement bracket 260 replaces the door latch engagement bracket 60 in the vehicle door 12 of the first embodiment. Similar to the door latch engagement bracket 60, the door latch engagement bracket 260 includes a reinforcement attachment flange 264, a door panel attachment flange 266, a first transition part 268, an inclined part 270, a second transition part 272, a release lever restricting part 274 and a third transition part 276. The door latch engagement bracket 260 also includes two stiffening ribs 278. The only difference between the door latch engagement bracket 260 and the door latch engagement bracket 60 is the release lever restricting part 274. The release lever restricting part 274 of the door latch engagement bracket 260 has an opening 280 defined by a peripheral wall 274*a* that surrounds the opening 280 to define an elongated cutout. In view of the similarity between the first and third embodiments, further descriptions of the third embodiment have been omitted for the sake of brevity.

Figure 27:
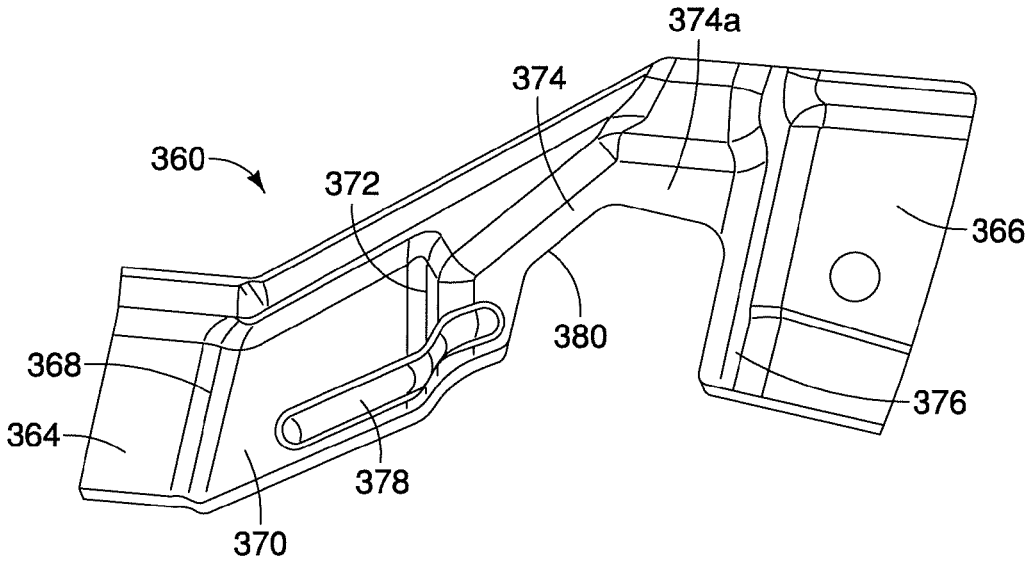
FIG. 27 is an outside side elevational view of another embodiment of a door latch engagement bracket.

Referring now to FIG. 27, a modified door latch engagement bracket 360 is illustrated in accordance with a fourth embodiment. The door latch engagement bracket 360 replaces the door latch engagement bracket 60 in the vehicle door 12 of the first embodiment. Similar to the door latch engagement bracket 60, the door latch engagement bracket 360 includes a reinforcement attachment flange 364, a door panel attachment flange 366, a first transition part 368, an inclined part 370, a second transition part 372, a release lever restricting part 374 and a third transition part 376. The only difference between the door latch engagement bracket 360 and the door latch engagement bracket 260 is a lower portion of the door latch engagement bracket 260 has been eliminated in the door latch engagement bracket 360. Thus, the door latch engagement bracket 360 has only one stiffening rib 378, and the release lever restricting part 374 has an opening 380 defined by a peripheral wall 374*a* that surrounds three sides of the opening 380 to define a U-shaped cutout. In view of the similarity between the first and fourth embodiments, further descriptions of the fourth embodiment have been omitted for the sake of brevity.

Figure 28:
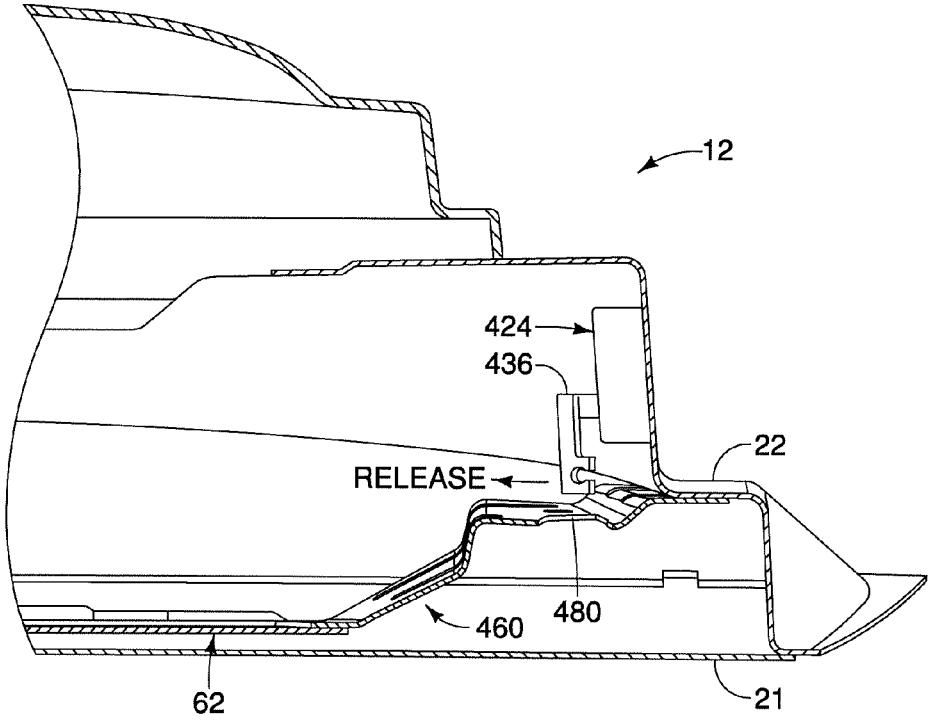
FIG. 28 is a simplified horizontal cross-sectional view of a rear portion of the vehicle door with selected parts removed to more clearly illustrate a door latch mechanism with a horizontally operated main latch release lever in the latched position.
Figure 29:
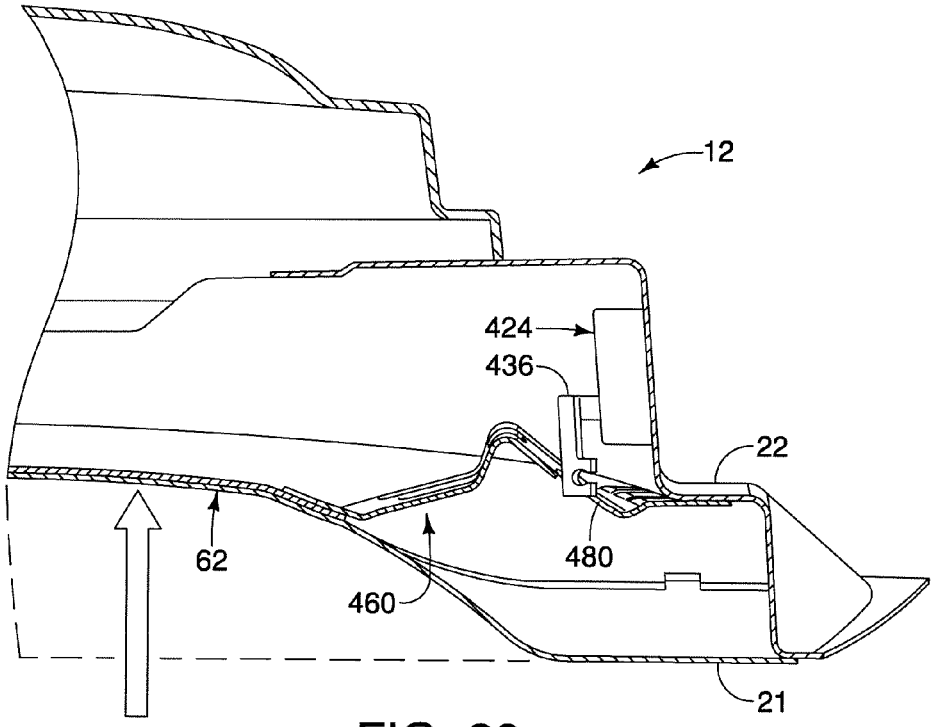
FIG. 29 is a simplified horizontal cross-sectional view of the rear portion of the vehicle door illustrated in FIG. 28, with selected parts removed to more clearly illustrate the main latch release lever passing into the opening of the door latch engagement bracket, after an impact force has acted on the outer panel of the vehicle door to plastically deform the door latch engagement bracket.

The door latch engagement brackets 60, 160, 260 and 360 can be used on a latch release lever which operates in a horizontal or angular direction instead of vertical movement by changing the shape and/or dimensions of the opening 80, 180, 280 and 380. For example, as seen in FIGS. 28 and 29, a latch mechanism 424 having a horizontally operated main latch release lever 436 is diagrammatically illustrated. The latch mechanism 424 replaces the latch mechanism 24 in the vehicle door 12. Here, the main latch release lever 436 moves horizontally between its rest position and a release position by a cable (not shown). Thus, a door latch engagement bracket 460, which is the same as the latch engagement bracket 60 (discussed above), but for its opening 480. The opening 480 is smaller in the horizontal direction for restricting movement of the main latch release lever 436 upon a side impact occurring at the vehicle door 12. In particular, the lateral edges of the opening 480 restrict movement of the main latch release lever 436 in the required (horizontal) direction, based on the design.

As used herein to describe the above embodiment(s), the following directional terms "forward", "rearward", "above", "downward", "vertical", "horizontal", "below" and "transverse" as well as any other similar directional terms refer to those directions of a vehicle equipped with the vehicle door latch structure. Accordingly, these terms, as utilized to describe the vehicle door latch structure should be interpreted relative to a vehicle that is equipped with the vehicle door latch structure in an installed position. The terms of degree such as "substantially", "about" and "approximately" as used herein mean a reasonable amount of deviation of the modified term such that the end result is not significantly changed.

While only selected embodiments have been chosen to illustrate the vehicle door latch structure, it will be apparent to those skilled in the art from this disclosure that various changes and modifications can be made herein without departing from the scope of the invention as defined in the appended claims. For example, the size, shape, location or orientation of the various components can be changed as needed and/or desired. Also for example, while many of the components of the door latch structure 24 are mounted to the inner door panel 22, these components are not limited to such mounting arrangements, but rather these components can be mounted to the outer door panel 21, if needed and/or desired. Components that are shown directly connected to or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle door latch structure comprising:

an inner door panel;

an outer door panel;

a door latch mechanism located between the inner door panel and the outer door panel, the door latch mechanism including a latch release lever that is movably arranged between a rest position and a release position unlatching the door latch mechanism; and a door latch engagement bracket defining an opening that is aligned with and spaced apart from the latch release lever while the latch release lever is in the rest position and while the door latch engagement bracket is in an installed state between the inner door panel and the outer door panel, wherein the latch release lever being arranged relative to the opening of the door latch engagement bracket to extend through the opening upon movement of the door latch engagement bracket from the installed state to a restricted state caused by deformation of the outer door panel toward the inner door panel such that the door latch engagement bracket prevents movement of the latch release lever from the rest position to the release position while the latch release lever is extending through the opening in the door latch engagement bracket.

2. The vehicle door latch structure according to claim 1, wherein the door latch engagement bracket includes a peripheral wall defining at least a portion of the opening, and the peripheral wall engages the latch release lever to prevent movement of the latch release lever from the rest position to the release position.

3. The vehicle door latch structure according to claim 2, wherein the peripheral wall completely surrounds the opening to define an aperture in the door latch engagement bracket.

4. The vehicle door latch structure according to claim 2, wherein the peripheral wall surrounds three sides of the opening to define a U-shaped cutout.

5. The vehicle door latch structure according to claim 2, wherein the peripheral wall surrounds the opening to define an elongated cutout.

6. The vehicle door latch structure according to claim 1, wherein the latch mechanism is oriented such that the latch release lever moves vertically between the rest position and the release position.

7. The vehicle door latch structure according to claim 1, wherein the latch mechanism is oriented such that the latch release lever moves horizontally between the rest position and the release position.

8. The vehicle door latch structure according to claim 1, wherein the door latch engagement bracket includes a reinforcement attachment flange that is attached to a door reinforcement member and a door panel attachment flange attached to one of the inner door panel and the outer door panel.

9. The vehicle door latch structure according to claim 1, further comprising a door handle remotely spaced from and operatively coupled to the latch mechanism.

10. The vehicle door structure according to claim 1, further comprising a door reinforcement member attached at a first end to one of the inner door panel and the outer door panel and attached at a second end to a reinforcement attachment flange of the door latch engagement bracket, the door latch engagement bracket being attached to one of the inner door panel and the outer door panel.

11. The vehicle door structure according to claim 1, wherein the latch release lever moves along a movement path between the rest position and the release position in response to a door releasing operation of the door latch mechanism.

12. The vehicle door structure according to claim 11, wherein the door latch engagement bracket includes a release lever restricting part adjacent to the opening such that the release lever restricting part becomes disposed in the latch release lever movement path upon movement of the door latch engagement bracket toward the latch mechanism to block movement of the latch release lever along the movement path.

13. The vehicle door latch structure according to claim 1, further comprising a door reinforcement member disposed between the inner door panel and the outer door panel, the door reinforcement member being mounted at one end to the door latch engagement bracket.

14. The vehicle door latch structure according to claim 1, wherein the door latch engagement bracket includes a door reinforcement member, the door latch engagement bracket and the door reinforcement member being formed together as a one-piece, unitary member.

15. A vehicle door structure comprising:

an inner door panel;

an outer door panel;

a door latch mechanism located between the inner door panel and the outer door panel, the door latch mechanism including a latch release lever that is movably arranged between a rest position and a release position; and a door latch engagement bracket defining an opening that is aligned with the latch release lever while the latch release lever is in the rest position and while the door latch engagement bracket is in an installed state located between the inner door panel and the outer door panel, the latch release lever being arranged relative to the opening of the door latch engagement bracket to extend through the opening upon movement of the door latch engagement bracket from the installed state to a restricted state caused by deformation of the outer door panel toward the inner door panel, the door latch engagement bracket preventing movement of the latch release lever from the rest position to the release position while the latch release lever is extending through the opening in the door latch engagement bracket, the door latch engagement bracket including a removable part disposed within the opening in the installed state, and the removable part is removed from the opening when the door latch engagement bracket is moved from the installed state to the restricted state and the latch release lever extends through the opening.

16. The vehicle door structure according to claim 15, wherein the door latch engagement bracket includes a release lever restricting part adjacent to the opening such that the release lever restricting part becomes disposed in the latch release lever movement path upon movement of the door latch engagement bracket toward the latch mechanism to block movement of the latch release lever along the movement path, and the release lever restricting part and the removable part are integrally formed with a frangible portion surrounding the removable part such that the release lever restricting part is a peripheral wall that at least partially defines the opening and that is formed upon removal of the removable part.

17. A vehicle door latch structure comprising:

an inner door panel;

an outer door panel;

a door latch mechanism located between the inner door panel and the outer door panel, the door latch mechanism including a latch release lever that is movably arranged along a latch release lever movement path between a rest position and a release position; and a door latch engagement bracket disposed between the inner door panel and the outer door panel adjacent the latch release lever, the door latch engagement bracket extending in a direction that is transverse to the latch release lever, the door latch engagement bracket including an opening, a release lever restricting part adjacent the opening, and a plastic deformation part, the release lever restricting part being aligned with the latch release lever movement path and the opening being aligned with the latch release lever while the latch release lever is in the rest position, the plastic deformation part being configured to deform in response to a force moving the outer door panel toward the inner door panel and moving the door latch engagement bracket towards the door latch mechanism such that the door latch engagement bracket moves from an undeformed configuration to a deformed configuration with the latch release lever extending through the opening and the release lever restricting part being disposed in the latch release lever movement path and restricting movement of the latch release lever from the rest position to the release position while the door latch engagement bracket is in the deformed configuration.

18. The vehicle door latch structure according to claim 17, wherein the door latch engagement bracket includes a door reinforcement member, the door latch engagement bracket and the door reinforcement member being formed together as a one-piece, unitary member.

19. A vehicle door latch structure comprising:

an inner door panel;

an outer door panel;

a door latch mechanism located between the inner door panel and the outer door panel, the door latch mechanism including a latch release lever that is movably arranged between a rest position and a release position unlatching the door latch mechanism; and a door latch engagement bracket coupled to a member located between the inner door panel and the outer door panel, the door latch engagement bracket defining an opening that is aligned with and spaced apart from the latch release lever while the latch release lever is in the rest position and while the door latch engagement bracket is in an installed state, the latch release lever being arranged relative to the opening of the door latch engagement bracket to extend through the opening upon movement of the door latch engagement bracket from the installed state to a restricted state caused by deformation of the outer door panel toward the inner door panel such that the door latch engagement bracket prevents movement of the latch release lever from the rest position to the release position while the latch release lever is extending through the opening in the door latch engagement bracket.

20. The vehicle door latch structure according to claim 19, wherein the door latch engagement bracket includes a reinforcement attachment flange and a door panel attachment flange.

21. The vehicle door latch structure according to claim 20, wherein the reinforcement attachment flange is attached to the member and the door panel attachment flange is attached to one of the inner door panel and the outer door panel.

22. The vehicle door latch structure according to claim 19, wherein the member is a door reinforcement member.

* * * * *